US009023570B2

(12) United States Patent
Shiba et al.

(10) Patent No.: US 9,023,570 B2
(45) Date of Patent: May 5, 2015

(54) TONER, DEVELOPER, AND IMAGE FORMING APPARATUS

(75) Inventors: Masana Shiba, Shizuoka (JP); Ryuta Chiba, Miyagi (JP); Tsuneyasu Nagatomo, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 14 days.

(21) Appl. No.: 13/877,108

(22) PCT Filed: Oct. 18, 2011

(86) PCT No.: PCT/JP2011/074374
§ 371 (c)(1),
(2), (4) Date: Mar. 29, 2013

(87) PCT Pub. No.: WO2012/053653
PCT Pub. Date: Apr. 26, 2012

(65) Prior Publication Data

US 2013/0216944 A1 Aug. 22, 2013

(30) Foreign Application Priority Data

Oct. 22, 2010 (JP) ..... 2010-237536

(51) Int. Cl.
*G03G 9/08* (2006.01)
*G03G 9/087* (2006.01)

(52) U.S. Cl.
CPC ..... *G03G 9/0819* (2013.01); *G03G 9/0804* (2013.01); *G03G 9/0806* (2013.01); *G03G 9/0827* (2013.01); *G03G 9/08755* (2013.01); *G03G 9/08782* (2013.01); *G03G 9/08795* (2013.01)

(58) Field of Classification Search
CPC ..... G03G 9/0819; G03G 8/0821
USPC ..... 430/108.1, 110.1, 110.3, 109.4
See application file for complete search history.

(56) References Cited

U.S. PATENT DOCUMENTS

| | | | |
|---|---|---|---|
| 2,297,691 | A | 10/1942 | Carlson |
| 5,935,751 | A | 8/1999 | Matsuoka et al. |
| 7,455,942 | B2 | 11/2008 | Nagatomo et al. |
| 2007/0218383 | A1 | 9/2007 | Seshita et al. |
| 2007/0218385 | A1 | 9/2007 | Kojima et al. |

(Continued)

FOREIGN PATENT DOCUMENTS

| | | |
|---|---|---|
| JP | 08-062884 | 3/1996 |
| JP | 2663016 | 6/1997 |

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

(Continued)

*Primary Examiner* — Christopher Rodee
(74) *Attorney, Agent, or Firm* — Oblon, McClelland, Maier & Neustadt, L.L.P.

(57) ABSTRACT

A toner contains a binder resin, a colorant, and a releasing agent, wherein the toner contains toner particles, and wherein a proportion of the toner particles containing one or more voids having diameters D1 of larger than 0.0 μm but 0.5 μm or smaller is more than 5.0% to 60%, and a proportion of the toner particles containing one or more voids having diameters D2 of 1.0 μm or larger is 10% or less.

15 Claims, 3 Drawing Sheets

(56) References Cited

U.S. PATENT DOCUMENTS

| | | | | |
|---|---|---|---|---|
| 2007/0218387 | A1 | 9/2007 | Ishii et al. | |
| 2007/0275315 | A1 | 11/2007 | Nagatomo et al. | |
| 2008/0069616 | A1 | 3/2008 | Kojima et al. | |
| 2008/0070144 | A1 | 3/2008 | Nagatomo et al. | |
| 2008/0227015 | A1 | 9/2008 | Nagatomo et al. | |
| 2008/0233505 | A1 | 9/2008 | Nagatomo et al. | |
| 2008/0268363 | A1* | 10/2008 | Nair et al. | 430/109.1 |
| 2009/0067876 | A1 | 3/2009 | Seshita et al. | |
| 2009/0098288 | A1* | 4/2009 | Massa et al. | 427/212 |
| 2009/0142093 | A1 | 6/2009 | Sawada et al. | |
| 2009/0142094 | A1 | 6/2009 | Sawada et al. | |
| 2009/0142685 | A1 | 6/2009 | Nagatomo et al. | |
| 2009/0142686 | A1 | 6/2009 | Kojima et al. | |
| 2010/0075243 | A1 | 3/2010 | Shimota et al. | |
| 2010/0075245 | A1 | 3/2010 | Watanabe et al. | |
| 2010/0081075 | A1 | 4/2010 | Watanabe et al. | |
| 2010/0119255 | A1 | 5/2010 | Seshita et al. | |
| 2010/0310980 | A1 | 12/2010 | Sugimoto et al. | |
| 2011/0033794 | A1 | 2/2011 | Watanabe et al. | |
| 2011/0076607 | A1 | 3/2011 | Sugimoto et al. | |
| 2011/0076610 | A1 | 3/2011 | Ogawa et al. | |
| 2011/0123920 | A1* | 5/2011 | Nair et al. | 430/110.1 |
| 2011/0136059 | A1* | 6/2011 | Yang | 430/137.14 |
| 2011/0151372 | A1 | 6/2011 | Watanabe et al. | |
| 2011/0200928 | A1 | 8/2011 | Watanabe et al. | |
| 2011/0255899 | A1 | 10/2011 | Iwamoto et al. | |
| 2011/0294058 | A1 | 12/2011 | Shiba et al. | |
| 2012/0003581 | A1* | 1/2012 | Yang et al. | 430/137.14 |
| 2012/0021347 | A1 | 1/2012 | Shimota et al. | |
| 2012/0295194 | A1* | 11/2012 | Cardoso et al. | 430/110.2 |
| 2013/0011782 | A1* | 1/2013 | Sano et al. | 430/137.21 |

FOREIGN PATENT DOCUMENTS

| | | |
|---|---|---|
| JP | 10-020552 | 1/1998 |
| JP | 11-007156 | 1/1999 |
| JP | 2000-275907 | 10/2000 |
| JP | 3225889 | 8/2001 |
| JP | 2004-226669 | 8/2004 |
| JP | 2005025171 A * | 1/2005 |
| JP | 2005-134497 | 5/2005 |
| JP | 2008-112074 | 5/2008 |
| JP | 2008-180924 | 8/2008 |
| JP | 2008-257056 | 10/2008 |
| JP | 4400901 | 11/2009 |
| JP | 2010-139912 | 6/2010 |
| WO | WO 2011115203 A1 * | 9/2011 |

OTHER PUBLICATIONS

English language machine translation of JP 2008-180924 (Aug. 2008).*

English language machine translation of JP 2008-257056 (Oct. 2008).*

International Search Report Issued Nov. 29, 2011 in PCT/JP2011/074374 Filed Oct. 18, 2011.

* cited by examiner

TONER, DEVELOPER, AND IMAGE FORMING APPARATUS

TECHNICAL FIELD

The present invention relates to a toner, a developer and an image forming apparatus, suitably used for electrophotography, electrostatic recording, electrostatic printing, and the like.

BACKGROUND ART

Image formation by electrophotography is generally performed by a process which includes forming an electrostatic image on a photoconductor (electrostatic image bearing member), developing the electrostatic image with a developer so as to form a visible image (toner image), transferring the visible image onto a recording medium such as paper, and fixing the transferred visible image onto the recording medium with application of heat, pressure, a solvent gas, etc. so as to obtain a fixed image (see PTL 1).

Regarding the developer, one-component developers for which magnetic toners or nonmagnetic toners are solely used, and two-component developers composed of toners and carriers are known. One-component developing methods are classified into magnetic one-component developing methods and nonmagnetic one-component developing methods, depending upon whether or not magnetic force is used to keep toner particles on a developing roller.

As for the toners, each toner is generally produced by a kneading pulverization method in which a thermoplastic resin is melt-kneaded along with a colorant, etc., and then finely pulverized and classified. Additionally, if necessary, inorganic fine particles or organic fine particles may be added to surfaces of toner particles, for the purpose of improving the fluidity and cleanability of the toner particles.

Recent years, the method of providing toner releasability without application of oil to a heat roll, and adding a release agent such as a wax to a toner for preventing the problem of fusion of the toner is generally employed. Here, the toner releasability with respect to the heat roll is greatly affected by the dispersed state of the wax in the toner.

When the wax is compatible with a binder resin of the toner, toner releasability cannot be sufficiently exhibited, and the wax can exist as domain particles, thereby exhibiting toner releasability. On this occasion, when the dispersion diameter of the domain particles is too large, the proportion of the wax localized near the surfaces of toner particles relatively increases; thus, the domain particles may aggregate, causing degradation of particle fluidity, the wax or a carrier may transfer to a photoconductor, etc. during long-term use, causing filming, and so it may be impossible to obtain favorable image quality. When the dispersion diameter of the domain particles is too small, the wax is finely dispersed to excess and thus adequate toner releasability may not be yielded.

In the kneading pulverization method, since it is difficult to control the dispersion diameter of the domain particles of the wax is liable to be present on fracture surfaces, the amount of the wax exposed at the toner surface is large and so the above problems such as degradation of particle fluidity and occurrence of filming may arise. Further, there exist the following problems: the toner obtained by the kneading pulverization method generally has a broad particle size distribution, varies in frictional chargeability and easily causes fogging and the like; also, it is difficult to obtain a small-particle-diameter toner, i.e., a volume average particle diameter of 2 μm to 8 μm for reasons related to production efficiency, and the demand for improvement in image quality can hardly be met.

Accordingly, toners obtained by granulation in an aqueous phase have received an attention. The toners have narrow particle size distributions, can be easily reduced in particle diameter, and obtain a high-quality, high-definition image, and are superior in offset resistance and low-temperature fixing ability due to high dispersion of a release agent such as a wax.

Also, the toners are superior in transfer ability due to their uniform chargeability, and favorable in terms of fluidity, which gives an advantage in terms of design of a developing device, for example, it is possible to design a hopper with more freedom and reduce the toque with which a developing roll is rotated.

As the toners obtainable by granulation in an aqueous phase, toners obtainable by a suspension polymerization method or an emulsion polymerization aggregation method (hereinafter also referred to as chemical toners) have been conventionally developed.

The suspension polymerization method is a method of obtaining toner particles by adding a monomer, a polymerization initiator, a colorant, a wax, etc. into an aqueous phase containing a dispersion stabilizer with stirring so as to form oil droplets, and then increasing the temperature to effect polymerization reaction. The suspension polymerization method can achieve reduction in the diameter of the toner particles. By the suspension polymerization method, it is difficult to make the wax appropriately present on the surfaces of the toner particles unless a dispersion stabilizer is used, because the wax tends to enter the oil droplets easily when the oil droplets are being formed; here, there is a problem in which if the dispersion stabilizer remains, it causes a decrease in chargeability. Only spherical shaped toner particles are obtained, there is a problem of cleaning.

As the emulsion polymerization aggregation method, there is, for example, a method proposed in which a polyester resin is used as a binder resin; fine particles obtained by subjecting the polyester resin to emulsion dispersion in an aqueous phase and then removing the solvent are aggregated with a dispersion formed by dispersing a colorant, a wax (release agent), etc. in an aqueous phase; and the aggregated matter is heated and fused so as to produce toner particles (see PTLs 2 and 3). In this method, the shape can be controlled by controlling a heat-fusing temperature and time. According to this method, since ultrafine particles are not generated, there is no loss of emulsification, and further, it is possible to produce a toner having a sharp particle size distribution without needing classification. However, when the fine particles obtained after the solvent removal are aggregated, mere aggregation of the fine particles leads to insufficient cohesion thereof, causing cracks or the like at interfaces after the cohesion. Therefore, a heating step for allowing the cohesion of the particles to proceed by heat is necessary. However, when the heating is carried out, blooming of a wax component finely dispersed in the toner particles may arise (the wax component may be deposited on the surfaces), the wax formed into spherical shape, and/or aggregation, etc. of finely dispersed particles of the wax may arise, thereby making it impossible to maintain the state in which the wax is finely dispersed in a sufficient manner. Especially in the case where a wax (release agent) having a low melting point is used, it easily melts in the heating step, and thus there is a problem in which favorable toner releasability cannot be secured and so there is a lack of suitability of the toner for oilless toner fixation with a heat roller.

Meanwhile, there has been proposed a method of adding, to a toner composition, wax fine particles which are covered or impregnated with a vinyl polymer by adding a polymerizable vinyl monomer and a water-soluble polymerization initiator to a wax emulsion to effect polymerization, when the toner composition is emulsified, so as to uniformly and firmly attach the wax fine particles to the toner surface (see PTL 4). However, this method requires polymerization of a wax emulsion and a polymerizable vinyl monomer; moreover, the glass transition temperature Tg of a resin contained in the wax fine particles is high; thus, there is a problem in which the toner is inferior in low-temperature fixing ability and releasability at low temperatures.

Meanwhile, there has been proposed a method in which a polymerizable monomer that contains a polar group-containing substance and a wax is subjected to suspension polymerization in water to produce a toner, and thus the toner contains a wax having a low melting point that is unable to be used for a toner produced by a pulverization method (see PTL 5). In this method, a pseudo-capsule structure is employed in which a nonpolar component such as a wax is not localized near the surfaces of toner particles, as opposed to a polar component, but covered with the polar component at the surfaces. However, the dispersion of the wax inside the toner particles is not analyzed and is therefore unknown.

Meanwhile, use of a toner has been proposed in which the amount of a wax contained therein is in the range of 0.1% by mass to 40% by mass, and the wax exposed at the toner surface accounts for 1% by mass to 10% by mass of the constituent compounds exposed on the toner surface (see PTL 6). The proportion of the wax exposed on the toner surface is measured by Electron Spectroscopy for Chemical Analysis (ESCA) and thus determined. However, analysis based upon ESCA can be performed only within approximately 0.1 μm in depth from the outermost surface of the toner, and thus it is difficult to know the dispersed state of the wax which lies further inside and suitably exhibits toner releasability in a fixing step.

There has been proposed a method for producing a toner, in which the toner is heated at the temperature range which is −10° C. of a glass transition temperature of the toner or higher, but lower than the glass transition temperature thereof +10° C. for surface treatment, in order to improve transfer ability. In this method, degradation of resistance to smear is not described, and unknown (see PTL 7).

On the other hand, when in a fixing device, a toner and the like adhere to and accumulate on a periphery of a fixing belt or fixing roller, fixing ability is degraded, and the toner, etc. further accumulates thereon, causing degradation of image quality. Thus, conventionally, various methods for suitably cleaning a periphery of a fixing roller have been proposed. Examples thereof include a roller method in which a cleaning member is brought into contact with a periphery of a heating roller; a felt method in which a cleaning member formed of felt is slidingly contact with a heating roller; and a web method, in which a periphery of a fixing roller is cleaned with a web in the process that the web wound around a feeding roller is rolled up using a winding roller. For example, in PTL 8, there is a description of a cleaning device for a fixing unit using a cleaning web, but no description of a toner which can be efficiently cleaned. Recently, especially, copiers for production printing have been significantly developed, and there has been an advance in fixing at low temperature, improvement of fixing speed, double face printing of images with high image area ratio, and dealing with various paper except those for office use. As a result, a fixing unit is hard to be cleaned. In these fields, when the toner obtained by the above-described method is used, image failure (granular smear) may occur, because an offset toner is not sufficiently cleaned with a cleaning member, adheres to a fixing belt, a fixing roller or a pressure roller, and then is transferred to a recording medium. The cleaning ability of the offset toner, and the low temperature fixing ability and transfer ability of the toner are not satisfied simultaneously.

Therefore, it has been desired to provide a method for constantly, stably, efficiently producing a toner, which can form high quality images and has excellent resistance to smear with occurring less filming, while keeping advantages of the chemical toner having a small particle diameter and particle size distribution and excellent fluidity, but such a method has not yet been provided at the moment.

CITATION LIST

Patent Literature

PTL 1 U.S. Pat. No. 2,297,691
PTL 2 Japanese Patent Application Laid-Open (JP-A) No. 10-020552
PTL 3 JP-A No. 11-007156
PTL 4 JP-A No. 2004-226669
PTL 5 Japanese Patent (JP-B) No. 2663016
PTL 6 Japanese Patent (JP-B) No. 3225889
PTL 7 JP-A No. 2010-139912
PTL 8 JP-B No. 4400901

SUMMARY OF INVENTION

Technical Problem

The present invention solves conventional problems and attains the following object.

1. To provide a toner having excellent resistance to smear and capable of preventing contamination or bleeding (smear) caused by rubbing a fixed image.
2. To provide a toner having excellent flowability and excellent supplying ability.
3. To provide a toner having excellent low temperature fixing ability.
4. To provide a toner, which causes a small amount of an offset toner upon fixation.
5. To provide a toner, with which image quality is not degraded by adhesion of the offset toner.
6. To provide a toner and an image forming apparatus, which can achieve the above-described 1 to 5 at the same time.
7. To provide a toner and an image forming apparatus, which are excellent in transfer efficiency, cause less filming, leave less residual toner after transfer, and form high grade image.

Solution to Problem

Means for solving the problems are as follows.

<1> A toner contains at least a binder resin, a colorant, and a releasing agent, wherein the toner contains toner particles, and wherein a proportion of the toner particles containing one or more voids having diameters D1 of larger than 0.0 μm but 0.5 μm or smaller is more than 5.0% to 60%, and a proportion of the toner particles containing one or more voids having diameters D2 of 1.0 μm or larger is 10% or less.

<2> The toner according to <1>, wherein the toner is obtained by a method for producing the toner, the method containing: dissolving or dispersing in an organic solvent a toner material containing at least a binder resin, the colorant and the releasing agent, so as to form an oil phase, emulsifying or dispersing the oil phase in an aqueous medium, so as to form an emulsified or dispersed product; and heating the emulsified or dispersed product.

<3> The toner according to <2>, wherein the aqueous medium contains a surfactant, and the method further contains removing the surfactant after the emulsifying or dispersing, so as to form a slurry; and heating the slurry at a temperature represented by the following formula: a glass transition temperature (Tg) of the binder resin≤heat temperature≤Tg of the binder resin+15° C.

<4> The toner according to <3>, wherein the slurry is heated at 50° C. to 60° C. for 30 minutes or less.

<5> The toner according to any one of <2> to <4>, wherein the dissolving or dispersing is dissolving or dispersing in the organic solvent the toner material containing an active hydrogen group-containing compound, a polymer reactive with the active hydrogen group-containing compound, the colorant, the releasing agent, and an unmodified polyester resin, so as to produce a dissolved or dispersed product, and the emulsifying or dispersing is dispersing the dissolved or dispersed product in the aqueous medium containing a surfactant, and allowing the active hydrogen group-containing compound to react with the polymer reactive with the active hydrogen group-containing compound.

<6> The toner according to any one of <1> to <5>, wherein the releasing agent contains at least microcrystalline wax.

<7> A developer containing the toner according to any one of <1> to <6>, and a carrier.

<8> An image forming apparatus including: a latent electrostatic image bearing member; a latent electrostatic image forming unit configured to form a latent electrostatic image on the latent electrostatic image bearing member; a developing unit configured to develop the latent electrostatic image using the toner according to any one of <1> to <6>, so as to form a visible image; a transfer unit configured to transfer the visible image onto a recording medium; and a fixing unit configured to fix the transferred visible image on the recording medium, wherein the fixing unit is a fixing device, which includes: a fixing member configured to come into contact with the toner unfixed on a recording medium, and rotate and heat the toner; a pressure member configured to rotate in pressure-contact with the fixing member; and a cleaning member configured to clean a surface of the pressure member, the cleaning member being a web.

<9> An image forming method including: forming a latent electrostatic image on a latent electrostatic image bearing member; developing the latent electrostatic image using the toner according to any one of <1> to <6>, so as to form a visible image; transferring the visible image onto a recording medium; and fixing the transferred visible image on the recording medium, wherein the fixing is performed by a fixing device, which includes: a fixing member configured to come into contact with the toner unfixed on a recording medium, and rotate and heat the toner; a pressure member configured to rotate in pressure-contact with the fixing member; and a cleaning member configured to clean a surface of the pressure member, the cleaning member being a web.

Advantageous Effects of Invention

The present invention can solve the conventional problems, and achieves the following object, and can provide a toner which has excellent resistance to smear, and excellent low temperature fixing ability, and transfer ability of the toner, and can be suitably cleaned in case of toner offset, and form high quality images for a long period of time, with causing less filming, while keeping advantages of chemical toner having a small particle diameter and particle size distribution and excellent fluidity, and a developer using the toner, and an image forming apparatus using the toner.

DESCRIPTION OF EMBODIMENTS (Toner)

A toner of the present invention contains at least a binder resin, a colorant, and a releasing agent, and if necessary, further contains other components.

The toner is preferably produced by a method for producing the toner, the method including: dissolving or dispersing in an organic solvent a toner material containing a binder resin, a colorant and a releasing agent, so as to form an oil phase, emulsifying or dispersing the oil phase in an aqueous medium, so as to form an emulsified or dispersed product; and heating the emulsified or dispersed product.

Figure 4:
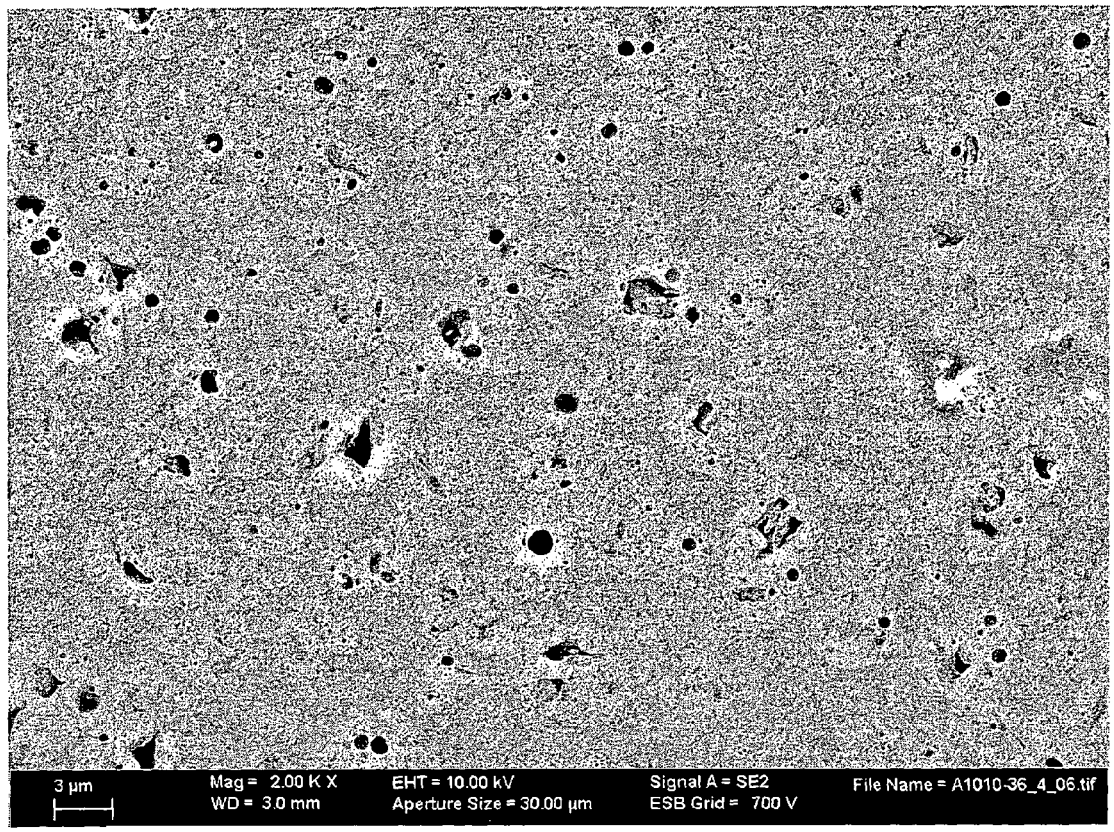
FIG. 4 is a picture showing voids formed in a toner.

In the present invention, it has been found that after the emulsifying or dispersing, the emulsified or dispersed product is heated, to thereby form voids in the toner as shown in FIG. 4. The principle of forming voids is not clearly known, but it is considered that air incorporated in the binder resin comes out and forms voids in the course of the heating performed after the emulsifying or dispersing. The voids in the toner are roughly classified into small voids each having a diameter of 0.5 μm or smaller (D1), and large voids each having a diameter of 1.0 μm or larger (D2). Since a large number of the small voids each having a diameter of 0.5 μm or smaller are distributed in the toner, particularly, the thermal conductivity of the toner is decreased and heat is not easily transferred, causing degradation of resistance to smear. When the large voids each having a diameter of 1.0 μm or larger are present, the toner has a structure that stress concentration easily occurs inside of the toner, and the strength to the stress is decreased, causing degradation of the resistance to smear. Moreover, because of the same reason, the large voids each having a diameter of 1.0 μm or larger increase occurrences of offset upon image fixation, causing image smear after the image fixation. That is, it is considered that this occurs because the aggregation force of toner particles is weaker than the adhesion strength of the toner to a fixing belt upon fixation.

It should be noted that the term "smear" used here means a phenomenon that an image is scraped away by rubbing after fixed by setting a deposition amount of the toner low. In an image formed with a small deposition amount of the toner, the toner is usually embedded in surface unevenness of paper, causing difficulty in directly transferring heat. Thus, toner particles are not fused with each other, and aggregation force is weaken, causing smear with ease. Thus, in order to solve these problems, it is necessary that heat is transferred to the toner so as to fuse the toner, and that the toner has a sufficient strength against rubbing.

The toner of the present invention is fixed by a fixing device, which includes a fixing member configured to come into contact with the toner unfixed on a recording medium, and rotate and heat the toner, a pressure member configured to rotate in pressure-contact with the fixing member, and a cleaning member configured to clean a surface of the pressure member, wherein the cleaning member is a web and located in the side of the pressure member. By cleaning the offset toner in the side of the pressure member, toner offset occurred during and after image fixation is efficiently cleaned, to thereby efficiently prevent image smear.

However, as described above, in the case where due to low resistance to smear, offset from a fixed image increases, and offset to a fixing belt or roller, and a pressure roller increases, the amount of the toner adhered to the web increases, and the offset toner cannot be held on the web. Then, the toner cooled and solidified on the web passes through the web, and adheres to a recording medium, causing image smear (granular smear).

Thus, it is important to control the small voids each having a diameter of 0.5 μm or smaller and the large voids each having a diameter of 1 μm or larger, in order to improve the resistance to smear, the cleaning ability of the fixing unit by decreasing offset to the fixing belt or roller and the pressure roller after image fixation, and to prevent image smear after the image fixation.

The toner contains toner particles, and a proportion of the toner particles containing one or more voids having diameters D1 of larger than 0.0 μm but 0.5 μm or smaller is more than 5.0% to 60%, and preferably 7% to 50%, more preferably 10% to 40%.

When the proportion is 5.0% or less, heating is not sufficiently performed after the emulsifying or dispersing, and the unevenness of the toner surface is large, causing decrease in transfer efficiency. When the proportion is more than 60%, the toner particles, to which heat is extremely hard to transfer, significantly increases. Thus, the resistance to smear is significantly degraded, and when a deposition amount of the toner is set low, the toner particles may not be fixed.

A proportion of the toner particles containing one or more voids having diameters D2 of 1.0 μm or larger is 10% or less, preferably 5% or less, more preferably 3% or less.

When the proportion is more than 10%, in the case where stress is externally applied to the toner particles, the amount of the toner particles, which are broken by stress concentration inside the toner particles, increases. Thus, offset amount upon fixation increases, and adhesion of offset toner may cause image smear.

Here, the proportion of the toner particles containing one or more voids is measured as follows. An epoxy resin is added dropwise to a stub specialized for a field-emission-type electron microscope. Toner particles are applied onto the epoxy resin and left to stand for one day so as to embed and fix the toner particles into the epoxy resin. The epoxy resin at the top of the stub is cut with an ultramicrotome (manufactured by Ultrasonic Co.) so as not to squash voids on the cross-sectional surfaces of the toner particles, to thereby avoid the case that voids cannot be observed because they are squashed and closed by the cutting. The cross-sectional surfaces of the toner particles are coated with carbon, and then 4 visual fields of the cross-sectional surfaces are observed through the field-emission-type electron microscope (ULTRA 55, manufactured by Carl Zeiss) under the following conditions (see FIG. 4). In FIG. 4, a black part shows a void, and a whitish gray part surrounding the black part shows a toner particle.

Measurement Conditions

Acceleration voltage: 10 kV

Measurement magnification: 2,000×

The diameter of the void is calculated from the scales shown in the observation display upon observation at 2,000×. The void is substantially circular in cross section, and thus the diameter thereof can be easily obtained. However, in the case where the shape of the void is deformed into ellipse, a minor axis of the void is substituted for the diameter.

The number of toner particles observed in each visual field is counted, and then the number of toner particles containing voids each having a diameter D1 of larger than 0.0 μm but 0.5 μm or smaller is counted, to thereby obtain a proportion of the toner particles containing voids. This process is repeated. Finally, the proportions of the toner particles in the 4 visual fields are averaged, to thereby determine the proportion of the toner particles containing voids each having a diameter D1.

Moreover, the number of toner particles observed in each visual field is counted, and then the number of toner particles containing voids each having a diameter D2 of 1.0 μm or larger is counted, to thereby obtain a proportion of the toner particles containing voids. This process is repeated. Finally, the proportions of the toner particles in the 4 visual fields are averaged, to thereby determine the proportion of the toner particles containing voids each having a diameter D2.

—Toner Material Liquid—

The toner material liquid is formed by dissolving or dispersing a toner material in an oil medium.

The toner material is not particularly limited and may be appropriately selected depending on the intended purpose, as long as a toner can be formed. For example, the toner material contains at least a binder resin, a colorant, and a releasing agent, and, if necessary, further contains other components such as a charge controlling agent.

A preferred embodiment of a method for producing a toner of the present invention is as follows: a wax dispersion liquid is previously produced by melting in a liquid the wax together with a resin and a wax dispersant, followed by cooling the mixture; and then the toner material liquid can be prepared by dissolving or dispersing in an oil medium the toner material containing a resin, an active hydrogen group-containing compound, a polymer reactive with the active hydrogen group-containing compound, the wax dispersion liquid, the colorant, and the charge controlling agent, etc. In the toner material the components other than the polymer (prepolymer) reactive with the active hydrogen group-containing compound, the wax, and the wax dispersant may be added in the aqueous medium upon preparation of the aqueous medium described below, or may be added with the toner material liquid in the aqueous medium upon addition of the toner material liquid in the aqueous medium.

The oil medium is a solvent which can dissolve or disperse the toner material, and preferably contains an organic solvent. The organic solvent is preferably removed while or after base particles of the toner are formed.

From the standpoint of its easy removal, the oil medium is preferably volatile, and has a boiling point of lower than 150° C. When the oil medium has a boiling point of 150° C. or higher, aggregation of toner particles may occur upon removal of the solvent.

Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. Of these, toluene, xylene, benzene, methylene chloride, 1,2-dichloroethane, chloroform, carbon tetrachloride are preferable, and ethyl acetate is particularly preferable. These may be used alone or in combination.

The amount of the organic solvent used is not particularly limited and may be appropriately selected depending on the intended purpose. The amount is preferably 40 parts by mass to 300 parts by mass, more preferably 60 parts by mass to 140 parts by mass, even more preferably 80 parts by mass to 120 parts by mass, relative to 100 parts by mass of the toner material.

The releasing agent (wax) dispersion liquid is formed by dispersing a releasing agent (wax) in a liquid, and preferably in the following manner: a releasing agent (wax) is heated and melted in a solvent which is the same as the solvent used for production of an oil phase, and rapidly cooled to recrystal, and the crystallized wax is finely pulverizing using a mill, and then the pulverized releasing agent is dispersed in the solvent. The heat temperature can be arbitrarily set depending on a solvent used. However, when it is not lower than the boiling point of the solvent, the solvent remarkably evaporates, and it may be difficult to produce the releasing agent dispersion liquid.

The releasing agent is not particularly limited and may be appropriately selected depending on the intended purpose. Specific examples of the releasing agent include petroleum waxes such as paraffin wax, and microcrystalline wax; and synthesized hydrocarbon waxes such as polyethylene wax. Moreover, from the standpoint of suppressing a volatile organic compound (VOC) derived from the wax and formed upon heating for fixation, a mass reduction at 165° C. of 15% by mass or less, more preferably 10% by mass or less. Thus, a microcrystalline wax having a low melting point is preferable from the standpoint of small volatile component upon fixation, and improvement of low temperature fixing ability of the resultant toner.

The melting point of the releasing agent is preferably low from the standpoint of improvement of low temperature fixing ability. The melting point is preferably 50° C. to 90° C., more preferably 60° C. to 80° C.

When the melting point is lower than 50° C., the heat resistant storage stability of the toner may be adversely affected by the releasing agent. When the melting point is higher than 90° C., cold offset easily arises upon fixing at low temperature.

The amount of the releasing agent is not particularly limited and may be appropriately selected depending on the intended purpose. It is preferably 3 parts by mass to 10 parts by mass, relative to 100 parts by mass of the resin component. When the amount of the releasing agent is less than 3 parts by mass, the releasability of the releasing agent cannot be sufficiently exerted, and a toner adheres to a fixing roller or fixing belt, and paper does not separate therefrom after fixation, possibly causing paper jam. When the amount of the releasing agent is more than 10 parts by mass, the amount of the releasing agent on a toner surface is excessively large, and a melted releasing agent adheres to a surface of a photoconductor or carrier during use, namely, filming occurs.

In the present invention, the mass decrease at 165° C. is measured, using thermal analysis devices TA-60WS and DTG-60 manufactured by SHIMADZU CORPORATION as measurement devices, under the following measurement conditions.

Measurement Conditions

Sample container: aluminum sample pan
Amount of sample: 5 mg
Reference: aluminum sample pan (sample pan alone)
Atmosphere: nitrogen (flow rate: 50 mL/min)
Temperature conditions
Initial temperature: 20° C.
Temperature increase rate: 10° C./min
End temperature: 165° C.
Holding time: 60 min.

The measurement results are analyzed using a data analysis software TA-60 ver. 1.52, manufactured by SHIMADZU CORPORATION.

The mass decrease at 165° C. is calculated by the following equation:

$$\text{Mass decrease at } 165^\circ\text{ C.} = (A-B)/A \times 100$$

where A denotes a mass at 165° C. for 0 minutes, i.e. the initial mass at 165° C., and B denotes a mass kept at 165° C. for 60 minutes.

The viscosity of the wax at 140° C. is not particularly limited and may be appropriately selected depending on the intended purpose. It is preferably 5 mPa·S to 15 mPa·S. By using the wax having high viscosity, a volatile organic compound (VOC), which is caused by vaporization of the wax upon fixation, can be reduced.

In the present invention, the viscosity of the wax can be measured using a rheometer, parallel plate rheometer AR2000, manufactured by TA Instruments. Japan. Specifically, the viscosity of the wax is measured using a parallel plate having a diameter of 20 mm, under the following conditions: a shear rate of 20 (1/S), and heating to a temperature of 180° C. at an increase rate of 10° C./rain.

In the present invention, the wax can be effectively dispersed using a styrene-acrylic resin composition as the wax dispersant.

The styrene-acrylic resin composition can be obtained by radically polymerizing a monomer using a known technique. It is preferably a butyl acrylate-acrylonitrile-styrene copolymer obtained by radically polymerizing butyl acrylate, acrylonitrile, and styrene as monomers using a radical initiator. A ratio of each monomer is not particularly limited and may be appropriately selected depending on the intended purpose.

More preferred is a block polymer, which is obtained by reaction of polyethylene with the resultant butyl acrylate-acrylonitrile-styrene copolymer. The wax and a fixing aid can be effectively dispersed in the toner by containing polyethylene site having high affinity to the wax and a styrene-acrylic resin having affinity to a polyester resin at the same time in the block polymer.

The amount of the wax dispersant is not particularly limited and may be appropriately selected depending on the intended purpose. It is preferably 40% by mass or more and less than 80% by mass, relative to the wax. The wax used in the present invention is not easily vaporized, and VOC can be reduced, but such wax has high melt viscosity and the wax itself has poor releasability. In the present invention, by adjusting the amount of the wax dispersant within the above-described range, VOC reduction and separability of the toner from paper, which conflict each other, can be achieved at the same time. It is considered that the wax dispersion state in the toner can be controlled with the amount of the wax dispersant, although its mechanism is not clearly understood. Namely, when the amount of the wax dispersant is less than 40% by mass, the wax is not dispersed, and deposited on a toner surface, causing filming. When the amount of the wax dispersant is 80% by mass or more, the wax is incorporated in a toner during heating and melting them, and becomes hard to ooze out from the toner, adversely affecting the separability of the toner from paper.

<Resin Component>

The resin component exerts adhesion to a recording medium such as paper, and contains a binder resin (binder resin A) and/or a binder resin precursor, and the binder resin precursor is preferably an active hydrogen group-containing compound and a polymer reactive with the active hydrogen group-containing compound.

The toner of the present invention preferably contains as the binder resin an adhesive polymer (binder resin B), which is obtained by reacting the active hydrogen group-containing compound and the polymer reactive with the active hydrogen group-containing compound (binder resin precursor) in an aqueous medium. By incorporating these in the toner, a gel component can be easily added thereinto. Moreover, the binder resin (binder resin A) appropriately selected from known binder resins can be incorporated in the toner.

In the present invention the binder resin (binder resin A) is not particularly limited and may be appropriately selected depending on the intended purpose. For example, as the binder resin (binder resin A) a polyester resin can be used, and an unmodified polyester rein is preferably used. By using the unmodified polyester rein, the low-temperature fixing ability of the toner and glossiness of an image can be improved. Examples of the unmodified polyester resin include polycondensation products of polyol and polycarboxylic acid.

The weight average molecular weight of the binder resin (binder resin A) is not particularly limited and may be appropriately selected depending on the intended purpose. It is preferably 3,000 to 30,000, more preferably 4,000 to 20,000. When the weight average molecular weight is less than 3,000, the hot offset resistance of the toner may decrease. Thus, the amount of a component having the weight average molecular weight of less than 3,000 is preferably 0% by mass to 28% by mass. When the weight average molecular weight is greater than 30,000, the low-temperature fixing ability may decrease.

The glass transition temperature of the binder resin (binder resin A) is not particularly limited and may be appropriately selected depending on the intended purpose. It is preferably 30° C. to 70° C., more preferably 35° C. to 65° C. When the glass transition temperature is lower than 30° C., the heat-resistant storage stability of the toner may degrade. When the glass transition temperature is higher than 70° C., the low-temperature fixing ability of the toner may be insufficient. Note that a toner containing as the binder resin a polyester resin obtained through a crosslinking reaction or an elongation reaction has excellent storage stability, even though the glass transition temperature thereof is low.

The hydroxyl value of the unmodified polyester resin is not particularly limited and may be appropriately selected depending on the intended purpose. It is preferably 5 mgKOH/g or greater, more preferably 10 mgKOH/g to 120 mgKOH/g, even more preferably 20 mgKOH/g to 80 mgKOH/g. When the hydroxyl value is less than 5 mgKOH/g, it may be difficult to achieve a favorable balance between heat-resistant storage stability and low-temperature fixing ability.

The acid value of the unmodified polyester resin is not particularly limited and may be appropriately selected depending on the intended purpose. It is preferably 10 mgKOH/g to 30 mgKOH/g. Thus, the toner can be negatively charged with ease.

The binder resin precursor is not particularly limited and may be appropriately selected depending on the intended purpose. It is preferably a polymer (hereinafter also referred to as "prepolymer") reactive with an active hydrogen group-containing compound. The prepolymer may be suitably selected from known resins, etc. Examples thereof include polyol resins, polyacrylic resins, polyester resins, epoxy resins, and derivatives of these resins. Of these, a polyester resin is preferably used in terms of transparency and high fluidity when melted. The above resins may be used alone or in combination.

The prepolymer's functional group(s) reactive with the active hydrogen group is not particularly limited and may be appropriately selected depending on the intended purpose. Examples thereof include an isocyanate group, an epoxy group, a carboxyl group, and the functional group represented by "—COC—". Of these, an isocyanate group is preferable. The prepolymer may have one functional group, or two or more functional groups.

As the prepolymer, use of a polyester resin which contains an isocyanate group, etc. capable of forming a urea bond is preferable because it is possible to easily adjust the molecular weight of a polymeric component and because it is possible to secure oilless low-temperature fixing ability of a dry toner, particularly to secure favorable releasability and fixability of the dry toner even without a mechanism of applying release oil to a heating medium for fixation.

The isocyanate group-containing polyester prepolymer is not particularly limited and may be appropriately selected depending on the intended purpose. Examples thereof include a reaction product of a polyisocyanate and an active hydrogen group-containing polyester resin obtained by subjecting polyol and polycarboxylic acid to polycondensation. Additionally, when the isocyanate group-containing polyester resin is reacted with the active hydrogen group-containing compound, a urethane bond may be formed by addition of an alcohol.

The polyol is not particularly limited and may be appropriately selected depending on the intended purpose. Examples thereof include diols, trihydric or higher alcohols, and mixtures of diols and trihydric or higher alcohols. Of these, diols, and mixtures each composed of a diol and a small amount of a trihydric or higher alcohol are preferable. These may be used alone or in combination.

Examples of the diols include alkylene glycols such as ethylene glycol, 1,2-propylene glycol, 1,3-propylene glycol, 1,4-butanediol and 1,6-hexanediol; oxyalkylene group-containing diols such as diethylene glycol, triethylene glycol, dipropylene glycol, polyethylene glycol, polypropylene glycol and polytetramethylene glycol; alicyclic diols such as 1,4-cyclohexanedimethanol and hydrogenated bisphenol A; alkylene oxide (such as ethylene oxide, propylene oxide, butylene oxide, etc.) adducts of alicyclic diols; bisphenols such as bisphenol A, bisphenol F and bisphenol S; and alkylene oxide (such as ethylene oxide, propylene oxide, butylene oxide, etc.) adducts of bisphenols. The alkylene glycols preferably have 2 to 12 carbon atoms each. Of these, C2-C12 alkylene glycols and alkylene oxide adducts of bisphenols are preferable, alkylene oxide adducts of bisphenols, and combinations of alkylene oxide adducts of bisphenols and C2-C12 alkylene glycols are particularly preferable.

Examples of the trihydric or higher alcohols include trihydric or higher aliphatic alcohols, trihydric or higher polyphenols, and alkylene oxide adducts of trihydric or higher polyphenols. Specific examples of the trihydric or higher alcohols include glycerin, trimethylolethane, trimethylolpropane, pentaerythritol and sorbitol. Specific examples of the trihydric or higher polyphenols include trisphenol PA, phenol novolac and cresol novolac. Specific examples of the alkylene oxide adducts of trihydric or higher polyphenols include trihydric or higher polyphenols to which allylene oxides such as ethylene oxide, propylene oxide and butylene oxide are added.

In the case where a diol and a trihydric or higher alcohol are mixed together, the mass ratio of the trihydric or higher alcohol to the diol is not particularly limited and may be appropriately selected depending on the intended purpose. It is preferably 0.01% by mass to 10% by mass, more preferably 0.01% by mass to 1% by mass.

The polycarboxylic acid is not particularly limited and may be appropriately selected depending on the intended purpose. Examples of the polycarboxylic acid include a dicarboxylic acid, a trivalent or higher carboxylic acid, and a mixture of a dicarboxylic acid and a trivalent or higher carboxylic acid. Of these, a dicarboxylic acid, and a mixture of a dicarboxylic acid and a small amount of a trivalent or higher carboxylic acid are preferable. These may be used alone or in combination.

Examples of the dicarboxylic acid include divalent alkanoic acids, divalent alkene acids and aromatic dicarboxylic acids. Examples of the divalent alkanoic acids include succinic acid, adipic acid and sebacic acid. The divalent alkene acids preferably have 4 to 20 carbon atoms each; examples thereof include maleic acid and fumaric acid. The aromatic dicarboxylic acids preferably have 8 to 20 carbon atoms each; examples thereof include phthalic acid, isophthalic acid, terephthalic acid and naphthalene dicarboxylic acid. Of these, C4-C20 divalent alkene acids and C8-C20 aromatic dicarboxylic acids are preferable.

As the trivalent or higher carboxylic acid, a trivalent or higher aromatic carboxylic acid, etc. may be used. The trivalent or higher aromatic carboxylic acid preferably has 9 to 20 carbon atoms; specific examples thereof include trimellitic acid and pyromellitic acid.

As the polycarboxylic acid, it is also possible to use an acid anhydride or lower alkyl ester of any one of a dicarboxylic acid, a trivalent or higher carboxylic acid, and a mixture of a dicarboxylic acid and a trivalent or higher carboxylic acid. Specific examples of the lower alkyl ester include methyl esters, ethyl esters and isopropyl esters.

In the case where a dicarboxylic acid and a trivalent or higher carboxylic acid are mixed together, the mass ratio of the trivalent or higher carboxylic acid to the dicarboxylic acid is not particularly limited and may be appropriately selected depending on the intended purpose. It is preferably 0.01% by mass to 10% by mass or less, more preferably 0.01% by mass to 1% by mass.

The mixture ratio between the polyol and the polycarboxylic acid at the time of polycondensation is not particularly limited and may be appropriately selected depending on the intended purpose. The equivalence ratio (the hydroxyl group/the carboxyl group) of the hydroxyl group of the polyol to the carboxyl group of the polycarboxylic acid is generally 1 to 2, preferably 1 to 1.5, particularly preferably 1.02 to 1.3.

The amount of a polyol-derived structural unit contained in the isocyanate group-containing polyester prepolymer is not particularly limited and may be appropriately selected depending on the intended purpose. It is preferably 0.5% by mass to 40% by mass, more preferably 1% by mass to 30% by mass, particularly preferably 2% by mass to 20% by mass. When the amount is less than 0.5% by mass, there may be a decrease in hot offset resistance, and it may be difficult to achieve a favorable balance between the heat-resistant storage stability and the low-temperature fixing ability of the toner. When the amount is more than 40% by mass, there may be a decrease in low-temperature fixing ability.

The polyisocyanate is not particularly limited and may be appropriately selected depending on the intended purpose. Examples thereof include aliphatic diisocyanates, alicyclic diisocyanates, aromatic diisocyanates, aromatic-aliphatic diisocyanates, isocyanurates, and these compounds blocked with phenol derivatives, oximes, caprolactam, etc.

Specific examples of the aliphatic diisocyanates include tetramethylene diisocyanate, hexamethylene diisocyanate, methyl 2,6-diisocyanatocaproate, octamethylene diisocyanate, decamethylene diisocyanate, dodecamethylene diisocyanate, tetradecamethylene diisocyanate, trimethylhexane diisocyanate and tetramethylhexane diisocyanate. Specific examples of the alicyclic diisocyanates include isophorone diisocyanate and cyclohexylmethane diisocyanate. Specific examples of the aromatic diisocyanates include tolylene diisocyanate, diisocyanatodiphenylmethane, 1,5-naphthylene diisocyanate, 4,4'-diisocyanatodiphenyl, 4,4'-diisocyanato-3,3'-dimethyldiphenyl, 4,4'-diisocyanato-3-methyldiphenylmethane and 4,4'-diisocyanato-diphenyl ether. Specific examples of the aromatic-aliphatic diisocyanates include $\alpha,\alpha,\alpha',\alpha'$-tetramethylxylylene diisocyanate. Specific examples of the isocyanurates include tris(isocyanatoalkyl) isocyanurate and tris(isocyanatocycloalkyl)isocyanurate. The polyisocyanate may be used alone or in combination.

The active hydrogen group-containing compound functions as an elongating agent, a crosslinking agent, etc., when the polymer reactive with the active hydrogen group-containing compound is subjected to an elongation reaction, a crosslinking reaction, etc. in the aqueous medium.

Examples of the active hydrogen group include hydroxyl groups, such as alcoholic hydroxyl group and phenolic hydroxyl group, amino groups, a carboxyl group and a mercapto group. These active hydrogen groups may be used alone or in combination.

The active hydrogen group-containing compound is not particularly limited and may be appropriately selected depending on the intended purpose. In the case where the polymer reactive with the active hydrogen group-containing compound is an isocyanate group-containing polyester prepolymer, the active hydrogen group-containing compound is preferably an amine, because it can have a high molecular weight by means of an elongation reaction, a crosslinking reaction, etc. with the polyester prepolymer.

The amines are not particularly limited and may be appropriately selected depending on the intended purpose. Examples thereof include diamines, trivalent or higher amines, amino alcohols, amino mercaptans, amino acids, and compounds obtained by blocking amino groups of these compounds. Of these, diamines, and mixtures each composed of a diamine and a small amount of a trivalent or higher amine are preferable. These may be used alone or in combination.

Examples of the diamines include aromatic diamines, alicyclic diamines and aliphatic diamines. Specific examples of the aromatic diamines include phenylenediamine, diethyltoluenediamine and 4,4'-diaminodiphenylmethane. Specific examples of the alicyclic diamines include 4,4'-diamino-3,3'-dimethyldicyclohexylmethane, diaminocyclohexane and isophoronediamine. Specific examples of the aliphatic diamines include ethylenediamine, tetramethylenediamine and hexamethylenediamine.

Examples of the trivalent or higher amines include diethylenetriamine and triethylenetetramine. Specific examples of the amino alcohols include ethanolamine and hydroxyethylaniline. Specific examples of the amino mercaptans include aminoethyl mercaptan and aminopropyl mercaptan. Specific examples of the amino acids include aminopropionic acid and aminocaproic acid. Specific examples of the compounds obtained by blocking the amino groups include oxazolidine compounds and ketimine compounds obtained by blocking the amino groups with ketones such as acetone, methyl ethyl ketone and methyl isobutyl ketone.

Also, a reaction terminator is used for terminating elongation and/or crosslinking reaction between the active hydrogen group-containing compound and the polymer reactive with the active hydrogen group-containing compound. Use of the reaction terminator can control the molecular weight, etc. of the adhesive base material to a desired range. The reaction terminator is not particularly limited, and examples thereof include monoamines, such as diethyl amine, dibutyl amine, butyl amine and lauryl amine; and product in which these amino groups are blocked, such as ketimine compounds.

The equivalence ratio (the isocyanate group/the amino group) of the isocyanate group of the polyester prepolymer to the amino group of the amine is not particularly limited and may be appropriately selected depending on the intended purpose. It is preferably 1/3 to 3/1, more preferably 1/2 to 2/1, particularly preferably 2/3 to 3/2. When the equivalence ratio is less than 1/3, there may be a decrease in low-temperature fixing ability. When the equivalence ratio is greater than 3/1, the molecular weight of the urea-modified polyester resin decreases, and thus there may be a decrease in hot offset resistance.

The average number of isocyanate groups per molecule of the polyester prepolymer is not particularly limited and may be appropriately selected depending on the intended purpose. It is preferably 1 or more, more preferably 1.2 to 5, even more preferably 1.5 to 4. When the average number is less than 1, the molecular weight of the urea-modified polyester resin decreases, and there may be a decrease in hot offset resistance.

The weight average molecular weight of the polymer reactive with the active hydrogen group-containing compound is not particularly limited and may be appropriately selected depending on the intended purpose. It is preferably 10,000 to 60,000, more preferably 20,000 to 50,000. When the weight average molecular weight is less than 10,000, there may be a decrease in heat-resistant storage stability. When the weight average molecular weight is greater than 60,000, there may be decrease in low-temperature fixing ability.

In the case where the toner includes the unmodified polyester resin, the mass ratio of the isocyanate group-containing polyester prepolymer to the unmodified polyester resin is not particularly limited and may be appropriately selected depending on the intended purpose. It is preferably 5/95 to 25/75, more preferably 10/90 to 25/75. When the mass ratio is less than 5/95, there may be decrease in hot offset resistance. When the mass ratio is greater than 25/75, there may be decrease in low-temperature fixing ability and image glossiness.

<Measurement of Weight Average Molecular Weight>

The weight average molecular weight can be determined by measuring the molecular weight distribution of a component soluble in tetrahydrofuran, utilizing gel permeation chromatography (GPC).

Here, the GPC measurement is performed as follows.

First, a method of forming a measurement sample is described. In the case of the unmodified polyester resin, in 5 mL of tetrahydrofuran 0.2 g of the unmodified polyester resin is dissolved, and the mixture is passed through a membrane filter, to thereby obtain a measurement sample.

On the other hand, in the case of the polymer reactive with the active hydrogen group-containing compound, which is not completed dissolved in tetrahydrofuran, 0.5 g of the polymer reactive with the active hydrogen group-containing compound is dissolved in 2 mL of dimethylformamide, and then 0.5 mL of methanol is further added therein, so as to completely dissolve the polymer reactive with the active hydrogen group-containing compound. The mixture is heated at 50° C. for 2 hours, to allow the isocyanate group to sufficiently react with methanol, diluted with 4 mL of tetrahydrofuran, and passed through a membrane filter, to thereby obtain a measurement sample.

As to the preparation of a measurement device, a column is stabilized in a heat chamber set at 40° C. At this temperature, tetrahydrofuran as a column solvent is applied at a flow rate of 1 mL/min, and 50 μL to 200 μL of a tetrahydrofuran solution with the concentration of a sample being adjusted to 0.05% by mass to 0.6% by mass is poured, followed by carrying out the measurement. The molecular weight is calculated based upon the relationship between count numbers and logarithmic values of a calibration curve produced using several types of standard samples. As the standard samples for producing the calibration curve, monodisperse polystyrenes, manufactured by Pressure Chemical Company or Toyo Soda Manufacturing Co., Ltd., having molecular weights of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$ respectively may be used. On this occasion, it is preferable to use standard samples of 10 types or so. Parenthetically, a refractive index detector may be employed as a detector.

Specific examples of the binder resin B in the toner include a mixture of (i) a polyester prepolymer (obtained by reacting isophorone diisocyanate with a polycondensation product of an ethylene oxide (2 mol) adduct of bisphenol A and isophthalic acid) urea-modified with isophoronediamine, and (ii) a polycondensation product of an ethylene oxide (2 mol) adduct of bisphenol A and isophthalic acid; a mixture of (i) a polyester prepolymer (obtained by reacting isophorone diisocyanate with a polycondensation product of an ethylene oxide (2 mol) adduct of bisphenol A and isophthalic acid) urea-modified with isophoronediamine, and (ii) a polycondensation product of an ethylene oxide (2 mol) adduct of bisphenol A and terephthalic acid; a mixture of (i) a polyester prepolymer (obtained by reacting isophorone diisocyanate with a polycondensation product of an ethylene oxide (2 mol) adduct of bisphenol A, a propylene oxide (2 mol) adduct of bisphenol A and terephthalic acid) urea-modified with isophoronediamine, and (ii) a polycondensation product of an ethylene oxide (2 mol) adduct of bisphenol A, a propylene oxide (2 mol) adduct of bisphenol A and terephthalic acid; a mixture of (i) a polyester prepolymer (obtained by reacting isophorone diisocyanate with a polycondensation product of an ethylene oxide (2 mol) adduct of bisphenol A, a propylene oxide (2 mol) adduct of bisphenol A and terephthalic acid) urea-modified with isophoronediamine, and (ii) a polycondensation product of a propylene oxide (2 mol) adduct of bisphenol A and terephthalic acid; a mixture of (i) a polyester prepolymer (obtained by reacting isophorone diisocyanate with a polycondensation product of an ethylene oxide (2 mol) adduct of bisphenol A and terephthalic acid) urea-modified with hexamethylenediamine, and (ii) a polycondensation product of an ethylene oxide (2 mol) adduct of bisphenol A and terephthalic acid; a mixture of (i) a polyester prepolymer (obtained by reacting isophorone diisocyanate with a polycondensation product of an ethylene oxide (2 mol) adduct of bisphenol A and terephthalic acid) urea-modified with hexamethylenediamine, and (ii) a polycondensation product of an ethylene oxide (2 mol) adduct of bisphenol A, a propylene oxide (2 mol) adduct of bisphenol A and terephthalic acid; a mixture of (i) a polyester prepolymer (obtained by reacting isophorone diisocyanate with a polycondensation product of an ethylene oxide (2 mol) adduct of bisphenol A and terephthalic acid) urea-modified with ethylenediamine, and (ii) a polycondensation product of an ethylene oxide (2 mol) adduct of bisphenol A and terephthalic acid; a mixture of (i) a polyester prepolymer (obtained by reacting diphenylmethane diisocyanate with a polycondensation product of an ethylene oxide (2 mol) adduct of bisphenol A and isophthalic acid) urea-modified with hexamethylenediamine, and (ii) a polycondensation product of an ethylene oxide (2 mol) adduct of bisphenol A and isophthalic acid; a mixture of (i) a polyester prepolymer (obtained by reacting diphenylmethane diisocyanate with a polycondensation product of an ethylene oxide (2 mol) adduct of bisphenol A, a propylene oxide (2 mol) adduct of bisphenol A, terephthalic acid and dodecenyl succinic anhydride) urea-modified with hexamethylenediamine, and (ii) a polycondensation product of an ethylene oxide (2 mol) adduct of bisphenol A, a propylene oxide (2 mol) adduct of bisphenol A and terephthalic acid; and a mixture of (i) a polyester prepolymer (obtained by reacting toluene diisocyanate with a polycondensation product of an ethylene oxide (2 mol) adduct of bisphenol A and isophthalic acid) urea-modified with hexamethylenediamine, and (ii) a polycondensation product of an ethylene oxide (2 mol) adduct of bisphenol A and isophthalic acid.

A polymerization catalyst can be used for production of the unmodified polyester resin and the prepolymer. Specific examples of the catalyst include dibutyltin laurate and dioctyltin laurate.

In addition to the components described above, the toner of the present invention may further contain a colorant, a charge controlling agent, resin particles, inorganic particles, a flowability improver, a cleanability improver, a magnetic material, and a metal soap.

<Colorant>

The colorant is not particularly limited and may be appropriately selected from known colorants depending on the intended purpose. Examples thereof include carbon black, nigrosine dye, iron black, naphthol yellow S, Hansa yellow (10 G, 5 G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5 G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower and lithopone, and mixture thereof.

The amount of the colorant contained in the toner is not particularly limited and may be appropriately determined depending on the intended purpose. It is preferably 1% by mass to 15% by mass, more preferably 3% by mass to 10% by mass, relative to the toner.

<Charge Controlling Agent>

The charge controlling agent is not particularly limited and may be appropriately selected from those known in the art depending on the intended purpose. It is preferable to employ a substantially colorless or white charge control agent as colored charge control agents may change the color tone. Examples thereof include triphenylmethane dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. These may be used alone or in combination.

The charge controlling agent may be a commercially available product. Examples thereof include quaternary ammonium salt BONTRON P-51, oxynaphthoic acid-based metal complex E-82, salicylic acid-based metal complex E-84 and phenol condensate E-89 (manufactured by ORIENT CHEMICAL INDUSTRIES CO., LTD); quaternary ammonium salt molybdenum complex TP-302 and TP-415 (manufactured by Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036 and COPY CHARGE NX VP434 (manufactured by Hoechst AG); LRA-901 and boron complex LR-147 (manufactured by Japan Carlit Co., Ltd.); quinacridone; azo pigments; and polymeric compounds having, as a functional group, a sulfonic acid group, carboxyl group, quaternary ammonium salt, etc.

The charge controlling agent may be dissolved or dispersed after melt-kneaded with the masterbatch, or may be dissolved or dispersed along with the components of the toner in a solvent, or may be fixed to the surface of the toner after the toner has been produced.

The amount of the charge controlling agent in the toner varies depending upon the type of the binder resin used, the presence or absence of an additive, the dispersing process employed, etc. and therefore cannot be unequivocally defined. Nevertheless, the amount of the charge controlling agent is preferably 0.1% by mass to 10% by mass, more preferably 0.2% by mass to 5% by mass, relative to the binder resin. When the amount of the charge controlling agent is less than 0.1% by mass, favorable charge controlling properties may not be obtained. When the amount thereof is greater than 10% by mass, the chargeability of the toner is so great that the electrostatic attraction between the toner and a developing roller increases, possibly causing degradation of the fluidity of the developer and a decrease in image density.

<Resin Particles>

A resin used as resin particles is not particularly limited and may be appropriately selected from known resins depending on the intended purpose, as long as the resin particles can form an aqueous dispersion liquid in an aqueous medium. The resin used as the resin particles may be thermoplastic resins or thermosetting resins. Examples of the resins include vinyl resins, polyurethane resins, epoxy resins, polyester resins, polyamide resins, polyimide resins, silicon resins, phenol resins, melamine resins, urea resins, aniline resins, ionomer resins and polycarbonate resins. Of these, at least one selected from vinyl resins, polyurethane resins, epoxy resins and polyester resins is preferable, from the viewpoint of easy preparation of an aqueous dispersion liquid containing spherical resin particles. These may be used alone or in combination.

The vinyl resin is a homopolymer or copolymer of a vinyl monomer. Examples thereof include styrene-(meth)acrylate ester copolymers, styrene-butadiene copolymers, (meth) acrylic acid-acrylate ester polymers, styrene-acrylonitrile copolymers, styrene-maleic anhydride copolymers and styrene-(meth)acrylic acid copolymers.

Also, as the resin particles, particles of a copolymer obtained by polymerizing a monomer which contains a plurality of unsaturated groups can be used as well. The monomer which contains a plurality of unsaturated groups can be suitably selected depending on the intended purpose, and specific examples thereof include a sodium salt of methacrylic acid ethylene oxide adduct sulfate (ELEMINOL RS-30, manufactured by Sanyo Chemical Industries, Ltd.), divinylbenzene and 1,6-hexanediol diacrylate.

The resin particles can be obtained by polymerization using a known method; it is preferable to use an aqueous dispersion liquid of resin particles. Examples of methods of preparing the aqueous dispersion liquid of resin particles include: in the case of a vinyl resin, a method of producing an aqueous dispersion liquid of resin particles by polymerizing a vinyl monomer, using a suspension polymerization method, an emulsion polymerization method, a seed polymerization method or a dispersion polymerization method; in the case of a polyaddition or condensation resin such as a polyester resin, polyurethane resin or epoxy resin, a method of dispersing a precursor such as a monomer or oligomer, or a solution thereof into an aqueous medium in the presence of a certain dispersant and then curing it with application of heat or addition of a curing agent so as to produce an aqueous dispersion liquid of resin particles, a method of dissolving a certain emulsifier in a precursor such as a monomer or oligomer, or a solution thereof and then adding water so as to effect phase inversion emulsification; a method of pulverizing and classifying a resin with the use of a mechanical rotary type, jet-type, etc. fine pulverizer so as to obtain resin particles and then dispersing the resin particles into water in the presence of a certain dispersant, a method of spraying a resin solution in the form of mist so as to obtain resin particles and then dispersing the resin particles into water in the presence of a certain dispersant, a method of precipitating resin particles by adding a poor solvent to a resin solution or by cooling a resin solution dissolved in a solvent with heating, then removing the solvent so as to obtain resin particles, and subsequently dispersing the resin particles into water in the presence of a certain dispersant, a method of dispersing a resin solution into an aqueous medium in the presence of a certain dispersant and then carrying out heating, pressure reduction, etc. so as to remove the solvent, and a method of dissolving a certain emulsifier into a resin solution and then adding water so as to effect phase inversion emulsification.

<Inorganic Particles>

The inorganic particles are not particularly limited and may be appropriately selected depending on the intended purpose. Examples thereof include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. These inorganic particles may be used alone or in combination.

The primary particle diameter of the inorganic particles is not particularly limited and may be appropriately selected depending on the intended purpose. It is preferably 5 nm to 2 μm, more preferably 5 nm to 500 nm. The specific surface area of the inorganic particles, measured by the BET method, is preferably 20 $m^2/g$ to 500 $m^2/g$.

The amount of the inorganic particles included in the toner is preferably 0.01% by mass to 5.0% by mass.

<Flowability Improver>

The flowability improver is an agent for performing surface treatment to improve hydrophobic properties of a toner surface, and is capable of inhibiting the degradation of flowability or chargeability under high humidity environment. Specific examples of the flowability improver include silane coupling agents, silylation agents, silane coupling agents having a fluorinated alkyl group, organotitanate coupling agents, aluminum coupling agents, silicone oils, and modified silicone oils.

<Cleanability Improver>

The cleanability improver is an agent added to the toner to remove the developer remaining on a photoconductor or a primary transfer medium after transfer. Specific examples of the cleanability improver include metal salts of fatty acids such as stearic acid (e.g., zinc stearate and calcium stearate), resin particles formed by soap-free emulsion polymerization, such as polymethylmethacrylate particles and polystyrene particles. The resin particles preferably have a relatively narrow particle size distribution, and preferably have a volume average particle diameter of 0.01 μm to 1 μm.

<Magnetic Material>

The magnetic material is not particularly limited and may be appropriately selected from those known in the art depending on the intended purpose. Examples thereof include iron powder, magnetite and ferrite. Of these, a magnetic material having a white color is preferable in terms of color tone.

<Method for Producing Toner>

As the method for producing a toner, an oil phase containing a resin, a wax, a wax dispersant, and a colorant is preferably suspended in an aqueous medium, so as to produce a toner.

As the method for producing a toner by polymerization method, a method of producing toner base particles while producing an adhesive base material is described hereinbelow. In this method, synthesis of the polymer reactive with the active hydrogen group-containing compound, synthesis of the active hydrogen group-containing compound, preparation of an aqueous medium, preparation of a toner material liquid, emulsification or dispersing of the toner material, production of the adhesive base material, solvent removal, etc., are carried out.

The preparation of the aqueous medium can be achieved by dispersing resin particles into an aqueous medium. The amount of the resin particles to be added in the aqueous medium is not particularly limited and may be appropriately selected depending on the intended purpose. It is preferably 0.5% by mass to 10% by mass.

The toner material liquid can be prepared by dissolving or dispersing in a solvent a toner material containing the active hydrogen group-containing compound, the polymer reactive with the active hydrogen group-containing compound, the colorant, the wax, the wax dispersant, the charge controlling agent, and the unmodified polyester resin, etc.

In the toner material the components other than the polymer reactive with the active hydrogen group-containing compound, the wax, the wax dispersant may be added in the aqueous medium upon dispersing of the resin particles in the aqueous medium, or may be added in the aqueous medium upon addition of the toner material liquid in the aqueous medium.

The emulsification or dispersing of the toner material can be achieved by dispersing the toner material liquid in the aqueous medium. By allowing the active hydrogen group-containing compound and the polymer reactive with the active hydrogen group-containing compound to undergo elongation reaction and/or crosslinking reaction upon emulsification or dispersing of the toner material, an adhesive base material is produced.

The adhesive base material, such as the urea-modified polyester resin, etc., may be produced by emulsifying or dispersing in an aqueous medium a liquid containing a polymer reactive with the active hydrogen group-containing compound, e.g., isocyanate group-containing polyester prepolymer, together with an active hydrogen group-containing compound (e.g., amine) so that they undergo elongation reaction and/or crosslinking reaction in the aqueous medium, may be produced by emulsifying or dispersing the liquid containing the toner material in an aqueous medium in which the active hydrogen group-containing compound has been previously added so that they undergo elongation reaction and/or crosslinking reaction in the aqueous medium, or may be produced by emulsifying or dispersing the liquid containing the toner material in an aqueous medium and adding the active hydrogen group-containing compound so that they undergo elongation reaction and/or crosslinking reaction from particle interfaces in the aqueous medium. For the purpose of accelerating the reaction, the liquid containing the toner material in a slurry state after the emulsification or dispersion may be heated. When effecting the elongation reaction and/or crosslinking reaction from particle interfaces, the urea-modified polyester resin is preferentially formed on the toner particle surfaces being produced; thus it is possible to form a concentration gradient of the urea-modified polyester resin in the toner particles.

The reaction conditions, such as reaction time, reaction temperature, etc. used for the production of the adhesive base material by heating the liquid containing the toner material in the slurry state after the emulsification or dispersion are not particularly limited and may be appropriately determined depending on the combinations of the polymer reactive with the active hydrogen group-containing compound and the active hydrogen group-containing compound. The reaction time is not particularly limited and may be appropriately selected depending on the intended purpose. It is preferably from 10 minutes to 40 hours, more preferably from 2 hours to 24 hours. The reaction temperature is not particularly limited and may be appropriately selected depending on the intended purpose. It is preferably 150° C. or lower, more preferably 40° C. to 98° C. A reaction step may be performed immediately after emulsification or dispersion, or may be performed after a solvent is removed.

Methods of stably forming in an aqueous medium a dispersion liquid which contains a polymer reactive with the active hydrogen group-containing compound, such as an isocyanate group-containing polyester prepolymer, include a method in which a liquid prepared by dissolving or dispersing, in a solvent, the toner material such as the polymer reactive with the active hydrogen group-containing compound, the colorant, the wax, the wax dispersant, the charge controlling agent and the unmodified polyester resin is added into an aqueous medium phase and dispersed by means of shearing force.

The dispersion can be performed using a known dispersing machine, etc. Examples of the dispersing machine include low-speed shear dispersing machines, high-speed shear dispersing machines, frictional dispersing machines, high-pressure jet dispersing machines and ultrasonic dispersing machines. The high-speed shear dispersing machines are preferable, since the particle diameter of a dispersion can be adjusted to the range of 2 μm to 20 μm.

In the case where a high-speed shear dispersing machine is used, conditions such as the rotational speed, the dispersion time and the dispersion temperature are not particularly limited and may be appropriately selected depending on the intended purpose. The rotational speed is preferably 1,000 rpm to 30,000 rpm, more preferably 5,000 rpm to 20,000 rpm. The dispersion time is preferably 0.1 minutes to 5 minutes in the case of a batch type. The dispersion temperature is preferably 150° C. or lower, more preferably 40° C. to 98° C., under pressure. Note that, in general, the dispersion can be facilitated when the dispersion temperature is high.

The amount of the aqueous medium used when the toner material is emulsified or dispersed is not particularly limited and may be appropriately selected depending on the intended purpose. It is preferably 50 parts by mass to 2,000 parts by mass, more preferably 100 parts by mass to 1,000 parts by mass, relative to 100 parts by mass of the toner material. When the amount thereof used is less than 50 parts by mass, the dispersion state of the toner material may degrade, and toner base particles having a predetermined particle diameter may not be obtained. When the amount thereof used is greater than 2,000 parts by mass, there may be an increase in production costs.

In the step of emulsifying or dispersing the toner material liquid, use of a dispersant is preferable in that a dispersion such as oil droplets can be stabilized so as to have a desired shape and a sharp particle size distribution.

The dispersant may be appropriately selected depending on the intended purpose. Examples thereof include surfactants, sparingly water soluble inorganic compound dispersants, and polymeric protective colloids, with preference being given to surfactants. These may be used alone or in combination.

The surfactants are not particularly limited and may be appropriately selected depending on the intended purpose. Examples of the surfactants include anionic surfactants, cationic surfactants, nonionic surfactants and amphoteric surfactants.

Examples of the anionic surfactants include alkylbenzene sulfonates, α-olefin sulfonates and phosphoric acid esters, and fluoroalkyl group-containing anionic surfactants.

Examples of alkylbenzene sulfonates include sodium dodecylbenzene sulphonate, and sodium dodecylpolyoxyethylene sulfates. Examples of α-olefin sulfonates include sodium salt of ethylene oxide methacrylate adduct sulfate. Examples of the fluoroalkyl group-containing anionic surfactants include fluoroalkyl(C2-C10)carboxylic acids or metal salts thereof, disodium perfluorooctanesulfonylglutamate, sodium 3-[ω-fluoroalkyl(C6-C11)oxy]-1-alkyl(C3-C4)sulfonate, sodium 3-[ω-fluoroalkanoyl(C6-C8)-N-ethylamino]-1-propanesulfonate, fluoroalkyl(C11-C20)carboxylic acids or metal salts thereof, perfluoroalkylcarboxylic acids (C7-C13) or metal salts thereof, perfluoroalkyl(C4-C12)sulfonic acids or metal salts thereof, perfluorooctanesulfonic acid diethanolamide, N-propyl-N-(2-hydroxyethyl)perfluorooctanesulfonamide, perfluoroalkyl(C6-C10)sulfonamide propyltrimethylammonium salts, perfluoroalkyl(C6-C10)-N-ethylsulfonylglycine salts and monoperfluoroalkyl(C6-C16) ethyl phosphoric acid esters.

Examples of commercially available products of the fluoroalkyl group-containing anionic surfactants include, but not limited to, SURFLON S-111, S-112 and S-113 (manufactured by Asahi Glass Co., Ltd.); FLUORAD FC-93, FC-95, FC-98 and FC-129 (manufactured by Sumitomo 3M Limited); UNIDYNE DS-101 and DS-102 (manufactured by Daikin Industries, Ltd.); MEGAFACE F-110, F-120, F-113, F-191, F-812 and F-833 (manufactured by DIC Corporation); EETOP EF-102, 103, 104, 105, 112, 123A, 123B, 306A, 501, 201 and 204 (manufactured by Tohchem Products Co., Ltd.); FTERGENT 100 and 150 (manufactured by NEOS COMPANY LIMITED).

Examples of the cationic surfactants include amine salt surfactants such as alkylamine salts, aminoalcohol fatty acid derivatives, polyamine fatty acid derivatives and imidazoline; and quaternary ammonium salt surfactants such as alkyltrimethyl ammonium salts, dialkyl dimethyl ammonium salts, alkyl dimethyl benzyl ammonium salts, pyridinium salts, alkyl isoquinolinium salts and benzetonium chloride. Of these, fluoroalkyl group-containing aliphatic primary, secondary or tertiary amine acids, aliphatic quaternary ammonium salts such as perfluoroalkyl(C6-C10)sulfonamide propyltrimethylammonium salts, benzalkonium salts, benzethonium chloride, pyridinium salts, imidazolinium salts and the like are preferable.

The commercially available products of the cationic surfactants include, but not limited to, SURFLON S-121 (manufactured by Asahi Glass Co., Ltd.), FLUORAD FC-135 (manufactured by Sumitomo 3M Limited), UNIDYNE DS-202 (manufactured by Daikin Industries, Ltd.), MEGAFACE F-150 and F-824 (manufactured by DIC Corporation), EFTOP EF-132 (manufactured by Tohchem Products Co., Ltd.), and FTERGENT F-300 (manufactured by NEOS COMPANY LIMITED).

Examples of the nonionic surfactants include fatty acid amide derivatives and polyhydric alcohol derivatives.

Examples of the amphoteric surfactants include alanine, dodecyldi(aminoethyl)glycine, di(octylaminoethyl)glycine and N-alkyl-N,N-dimethylammoniumbetaine.

Examples of the sparingly water soluble inorganic compound dispersants include tricalcium phosphate, calcium carbonate, titanium oxide, colloidal silica and hydroxyappetite.

Examples of the polymeric protective colloids include homopolymers or copolymers (obtained by polymerizing, for example, a carboxyl group-containing monomer, a hydroxyl group-containing alkyl(meth)acrylate, a vinyl ether, a vinyl carboxylate, an amide monomer, a monomer of an acid chloride, a monomer containing a nitrogen atom or a heterocyclic ring thereof, etc.), polyoxyethylene resins and celluloses. Note that the homopolymers or the copolymers, obtained by polymerizing the above-mentioned monomers, include those having structural units derived from vinyl alcohol.

Examples of the carboxyl group-containing monomer include acrylic acid, methacrylic acid, α-cyanoacrylic acid, α-cyanomethacrylic acid, itaconic acid, crotonic acid, fumaric acid, maleic acid and maleic anhydride. Examples of the hydroxyl group-containing (meth)acrylic monomer include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylate, diethyleneglycol monomethacrylate, glycerin monoacrylate and glycerin monomethacrylate. Examples of the vinyl ether include vinyl methyl ether, vinyl ethyl ether and vinyl propyl ether. Examples of the vinyl carboxylate include vinyl acetate, vinyl propionate and vinyl butyrate. Examples of the amide monomer include acrylamide, methacrylamide, diacetone acrylamide, N-methylolacrylamide and N-methylolmethacrylamide. Examples of the monomer of an acid chloride include acrylic acid chloride and methacrylic acid chloride. Examples of the monomer containing a nitrogen atom or a heterocyclic ring thereof include vinyl pyridine, vinyl pyrolidone, vinyl imidazole and ethyleneimine. Examples of the polyoxyethylene resins include polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene phenyl stearate and polyoxyethylene phenyl pelargonate. Examples of the celluloses include methyl cellulose, hydroxyethyl cellulose and hydroxypropyl cellulose.

Examples of the dispersant include compounds soluble in acids and/or alkalis, such as calcium phosphate salts. In the case where a calcium phosphate salt is used as the dispersant, the calcium phosphate salt can be removed by a method of dissolving the calcium salt in hydrochloric acid or the like and carrying out washing with water, or by a method of decomposition with an enzyme.

Methods for removing an organic solvent from a dispersion liquid such as an emulsified slurry include a method of gradually increasing the temperature of the reaction system and thusly evaporating an organic solvent in oil droplets, a method of spraying a dispersion liquid into a dry atmosphere and thusly removing an organic solvent in oil droplets, and a method of reducing pressure and thusly evaporating a solvent.

When the dispersant is used, the dispersant is preferably removed by washing, etc., after an organic solvent is removed. After the dispersant is removed, water is preferably added to the oil phase to be in the slurry state, followed by heating it.

The slurry is obtained by removing the surfactant from the aqueous medium after the emulsifying or dispersing. The slurry is preferably heated at a temperature represented by the following formula: a glass transition temperature (Tg) of the binder resin≤heat temperature≤Tg of the binder resin+15° C., more preferably Tg of the binder resin≤heat temperature≤Tg of the binder rein+10° C., still more preferably Tg of the binder resin≤heat temperature≤Tg of the binder resin+5° C.

Specifically, the slurry is preferably heated at 50° C. to 60° C. for 30 minutes or less, more preferably heated at 50° C. to 60° C. for 0 minute to 30 minutes. Here, the slurry is heated for 0 minute means after the slurry is heated at a certain temperature, followed by immediately finishing heating, without keeping the temperature.

By heating the slurry at the following temperature range: a glass transition temperature (Tg) of the binder resin≤heat temperature≤Tg of the binder resin+15° C., the binder resin of the toner changes its shape, and the unevenness of the toner surface is smoothened. Since the toner surface becomes smooth, and an external additive can be uniformly adhered thereto, to thereby produce a toner having excellent transfer efficiency.

The unevenness of the toner base particle can be estimated from a BET specific surface area of the toner base particle. That is, the larger the unevenness of the toner base particle is, the larger the BET specific surface area becomes. The smaller the unevenness of the toner base particle is, the smaller the specific surface area becomes.

When the toner is heated at a temperature higher than the glass transition temperature of the binder rein by more than 15° C., the toner base particles are fused and formed into the slurry, and the toner base particles are not sharply distributed. The higher the heat temperature is, the smoother the surface of the toner base particles becomes, thereby decreasing the BET specific surface area. Consequently, coverage of the external additive increases, and the flowability and heat resistant storage stability of the toner are improved.

The toner base particles are formed by removing the surfactant, and heating and drying the slurry. The toner base particles can be further classified. The classification may be performed by removing fine particles in a liquid using a cyclone, a decanter, centrifugation, etc. or may be performed after the drying.

The obtained toner base particles may be mixed with inorganic particles. On this occasion, by applying mechanical impact, it is possible to suppress detachment of particles of the wax, etc. from the surfaces of the toner base particles.

Examples of methods of applying mechanical impact include a method of applying impact to the mixture with the use of blades which rotate at high speed, and a method of pouring the mixture into high-speed airflow and accelerating the mixture such that particles collide with one another or that the particles collide with a certain collision plate. Examples of apparatuses for use in these methods include ANGMILL (manufactured by Hosokawa Micron Corporation), an apparatus made by modifying I-type Mill (manufactured by Nippon Pneumatic Mfg. Co., Ltd.) with reduced pulverization air pressure, HYBRIDIZATION SYSTEM (manufactured by Nara Machinery Co., Ltd.), KRYPTRON SYSTEM (manufactured by Kawasaki Heavy Industries, Ltd.), and an automatic mortar.

The average circularity of the toner of the present invention is not particularly limited and may be appropriately selected depending on the intended purpose. It is preferably 0.955 to 0.975, more preferably 0.960 to 0.970. The average circularity is a value obtained by dividing a circumferential length of a circle having the same area as a projected area of a toner particle with a circumferential length of the toner particle. The amount of the particle having an average circularity of less than 0.955 is not particularly limited and may be appropriately selected depending on the intended purpose. It is preferably 15% or less. When the average circularity of the toner particles is less than 0.955, transfer ability may be unsatisfied and a toner dust-free high quality image may not be obtained. When the average circularity is more than 0.975, cleaning failures may occur on a photoconductor and transfer belt in an image forming apparatus equipped with a cleaning blade, causing smears on an image. For example, in a case of formation of an image that occupies a large area of a sheet (e.g., photographic image), background smears may occur, because, when paper feed failure or the like occurs, toner particles that have been used to develop the image remains unremoved and accumulates on the photoconductor, or, in that case, a charging roller which provides charges to the photoconductor in contact therewith is contaminated by residual toner particles and thus its original charge ability may be impaired.

The average circularity is measured by a technique of optical detecting zone, in which a suspension liquid containing the toner is passed through a detecting zone of an imaging part on a flat plate to optically detect images of particles by CCD camera and analyzed. For example, the average circularity can be measured using a flow particle image analyzer FPIA-3000, manufactured by SYSMEX CORPORATION.

The toner of the present invention can be used in various fields. The toner of the present invention can be suitably used for image formation by electrophotography.

The amount of tetrahydrofuran (THF)-insoluble matter in the toner is preferably 5% by mass to 25% by mass. When the amount of the tetrahydrofuran-insoluble matter is less than 5% by mass, the molecular weight of the resin in the toner is too large, the lower limit fixing temperature may be disadvantageously increased. When the tetrahydrofuran-insoluble matter is more than 25% by mass, the molecular weight of the resin in the toner is too small, the upper limit fixing temperature may decrease, and the range of fixing temperature is narrowed.

The tetrahydrofuran-insoluble matter can be identified by the following method.

Approximately 1.0 g (A) of toner is weighed.

To the toner approximately 50 g of THF is added, and left to stand at 20° C. for 24 hours.

The resultant mixture is centrifuged, and filtered using a quantitative filter paper.

A solvent of the filtrate is vacuum dried, and the residue amount (B) of a resin is measured.

The residue amount (B) is THF-soluble matter.

The THF-insoluble matter is obtained by the following Equation.

$$\text{THF-insoluble matter (\%)}=[(A-B)/A]\times 100$$

The volume average particle diameter of the toner of the present invention is not particularly limited and may be appropriately selected depending on the intended purpose. It is preferably 3 μm to 8 μm, more preferably 4 μm to 7 μm. When the volume average particle diameter is less than 3 μm, in the case of a two-component developer, the toner may fuses to a carrier surface when stirring is carried out for a long period of time in the developing device, possibly causing decrease in the chargeability of the carrier. In the case of a one-component developer, toner filming to a developing roller or toner fusing to members, such as a blade for forming a thin toner film, may occurs. When the volume average particle diameter is greater than 8 μm, it is difficult to obtain a high-resolution, high-quality image, and when the toner in the developer is supplied and consumed, the toner may greatly vary in particle diameter.

The ratio Dv/Dn of the volume average particle diameter Dv to the number average particle diameter Dn of the toner of the present invention is not particularly limited and may be appropriately selected depending on the intended purpose. It is preferably 1.00 to 1.25, more preferably 1.05 to 1.25. Accordingly, in the case of a two-component developer, even when the toner is supplied and consumed for a long period of time, the particle diameter of the toner in the developer less varies, and even after long-time use of a developing device, i.e. long-time stirring of developer, excellent and stable developability can be achieved. Meanwhile, in the case of a one-component developer, even when the toner is supplied and consumed, the particle diameter of the toner less varies, and toner filming to a developing roller and toner fusing to members, such as a blade for forming a thin toner film, are prevented, and in addition, even after long-time use of a developing device, i.e. long-time stirring of developer, excellent developing ability can be ensured. Thus, a high-quality image can be obtained. When the ratio Dv/Dn is greater than 1.25, it is difficult to obtain a high-resolution, high-quality image, and when the toner in the developer is supplied and consumed, the particle diameter of the toner may greatly vary.

It is preferred that the lower limit fixing temperature of the toner of the present invention be low and the temperature at which offset does not yet arise be high, in view of a favorable balance between the low-temperature fixing ability and the offset resistance of the toner. Accordingly, it is preferred that the lower limit fixing temperature be lower than 140° C. and the temperature at which offset does not yet arise be 200° C. or higher. Here, the lower limit fixing temperature is the lower limit of the fixation temperature at which the residual rate of the image density of an image obtained using an image forming apparatus after rubbed with a pad is 70% or more. The temperature at which offset does not yet arise can be determined by measuring the temperature at which offset does not arise, using an image forming apparatus adjusted such that an image is developed with a predetermined amount of the toner.

The thermal properties of the toner, also referred to as flow tester properties, are evaluated based upon the softening point, the flow start temperature, the ½ method softening point, etc. of the toner.

Figure 1:
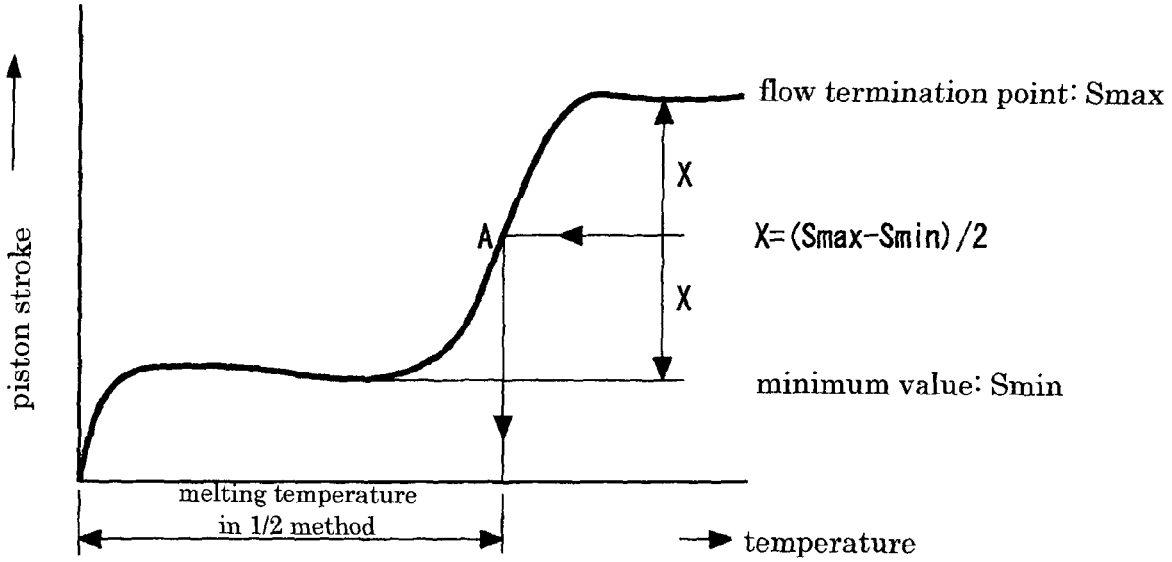
FIG. 1 is a chart for explaining the thermal properties of a toner of the present invention.

FIG. 1 is a chart for explaining the thermal properties of a toner of the present invention.

The thermal properties can be measured by suitably selected methods and can be measured using an elevated flow tester CFT500, manufactured by SHIMADZU CORPORATION. The flow curve obtained by the flow tester is shown in FIG. 1, and from which each temperature can be read. In FIG. 1, Ts denotes a softening point, Tfb denotes a flow start temperature, and Tend denotes a measurement end temperature. T½ temperature is a temperature at the time of half of the stroke amount from Tfb to Tend. In the present invention, T½ temperature is defined as a ½ method softening point.

The softening point Ts of the toner is preferably 30° C. or higher, more preferably 50° C. to 90° C. When the softening point Ts is lower than 30° C., the heat-resistant storage stability of the toner may degrade.

The flow start temperature Tfb of the toner of the present invention is preferably 60° C. or higher, more preferably 90° C. to 130° C. When the flow start temperature is lower than 60° C., at least one of the heat-resistant storage stability and the offset resistance of the toner may degrade.

The ½ method softening point of the toner of the present invention is preferably 90° C. or higher, more preferably 100° C. to 170° C. When the ½ method softening point is lower than 90° C., the offset resistance of the toner may degrade.

The glass transition temperature of the toner of the present invention is not particularly limited and may be appropriately selected depending on the intended purpose. It is preferably 40° C. to 70° C., more preferably 45° C. to 65° C. When the glass transition temperature is lower than 40° C., the heat resistant storage stability of the toner may degrade. When the glass transition temperature is higher than 70° C., the low-temperature fixing ability of the toner may not be sufficient. The glass transition temperature can be measured using a differential scanning calorimeter, DSC-60, manufactured by SHIMADZU CORPORATION, etc.

The density of an image formed using the toner of the present invention is not particularly limited and may be appropriately selected depending on the intended purpose. It is preferably 1.30 or greater, more preferably 1.45 or greater, even more preferably 1.50 or greater. When the image density is less than 1.30, the image density is so low that a high quality image may not be able to be obtained. The image density can be measured as follows: a tandem color image forming apparatus (IMAGIO NEO 450, manufactured by Ricoh Company, Ltd.) is used; the surface temperature of the fixing roller is set at 160° C.±2° C.; a solid image is formed on the copy paper TYPE 6200, manufactured by Ricoh Company, Ltd., with the amount of the developer attached being 0.35 $mg/cm^2$±0.02 $mg/cm^2$; the image density is measured in any five places on the obtained solid image, using the spectrometer 938 SPECTRODENSITOMETER, manufactured by X-Rite, Inc.; and the obtained image densities are averaged.

The color of the toner of the present invention may be appropriately selected depending on the intended purpose. The color can be at least one selected from the group consisting of black, cyan, magenta and yellow. The toners of each color can be obtained by suitably selecting respective colorants.

<Developer>

The developer of the present invention can used for image formation by various known electrophotographies, such as magnetic one-component developing methods and nonmagnetic one-component developing methods and two-component developing methods.

The developer of the present invention includes the toner of the present invention and may further include suitably selected other components such as a carrier. Thus, a high-quality image superior in transfer ability, chargeability, etc. can be stably formed. The developer may be a one-component developer or may be a two-component developer. It should, however, be noted that in the case where the developer is used in a high-speed printer, etc. adaptable to the present-day increase in information processing speed, the developer is preferably a two-component developer because its lifetime can lengthen.

In the case where the developer is used as a one-component developer, even when the toner is supplied and consumed, the particle diameter of the toner less varies, and toner filming to a developing roller and toner fusing to members, such as a blade for forming a thin toner film, are prevented, and in addition, even after long-time use of a developing device, i.e. long-time stirring of developer, excellent developing ability can be ensured.

In the case where the developer is used as a two-component developer, even when the toner is supplied and consumed for a long period of time, the particle diameter of the toner in the developer less varies, and even after long-time use of a developing device, i.e. long-time stirring of developer, excellent and stable developability can be achieved.

The carrier is not particularly limited and may be appropriately selected depending on the intended purpose, and the carrier preferably includes a core material, and a resin layer which covers the core material.

The material for the core material is not particularly limited and may be suitably selected from known materials. Examples thereof include manganese-strontium materials (50 emu/g to 90 emu/g) and manganese-magnesium materials (50 emu/g to 90 emu/g). To secure an appropriate image density, use of a highly magnetized material such as iron powder (100 emu/g or greater) or magnetite (75 emu/g to 120 emu/g) is preferable. Also, use of a weakly magnetized material such as a copper-zinc material (30 emu/g to 80 emu/g) is preferable in that the impact of developer particles formed on the photoconductor in an upright position applied thereto can be lessened and the image quality can be advantageously increased. These materials may be used alone or in combination.

The volume average particle diameter of the core material is not particularly limited and may be appropriately selected depending on the intended purpose. It is preferably 10 μm to 150 μm, more preferably 40 μm to 100 μm. When the volume average particle diameter is less than 10 μm, the large amount of fine powder exists in the carrier, which causes a decrease in magnetization per particle and scattering of the carrier. When the volume average particle diameter is greater than 150 μm, the specific surface area of the carrier decreases, possibly causing scattering of the toner and especially in the case of full-color images largely occupied by solid portions, possibly causing degraded reproduction of the solid portions.

The material for the resin layer is not particularly limited and may be suitably selected from known resins depending on the intended purpose. Examples thereof include amino resins; polyvinyl resins; polystyrene resins; polyhalogenated olefins; polyester resins; polycarbonate resins; polyethylene; polyvinyl fluoride; polyvinylidene fluoride; polytrifluoroethylene; polyhexafluoropropylene; copolymers of vinylidene fluoride and acrylic monomers; copolymers of vinylidene fluoride and vinyl fluoride; fluoroterpolymers such as a copolymer composed of tetrafluoroethylene, vinylidene fluoride and a monomer which contains no fluoro group; and silicone resins. These may be used alone or in combination.

Specific examples of the amino resins include urea-formaldehyde resins, melamine resins, benzoguanamine resins, urea resins, polyamide resins and epoxy resins. Specific examples of the polyvinyl resins include acrylic resins, polymethyl methacrylate, polyacrylonitrile, polyvinyl acetate, polyvinyl alcohol and polyvinyl butyral. Specific examples of the polystyrene resins include polystyrene and styrene-acrylic copolymers. Specific examples of the polyhalogenated olefins include polyvinyl chloride. Specific examples of the polyester resins include polyethylene terephthalate and polybutylene terephthalate.

If necessary, the resin layer may contain conductive powder, etc. Specific examples of the conductive powder include metal powder, carbon black, titanium oxide, tin oxide and zinc oxide. The average particle diameter of the conductive powder is not particularly limited and may be appropriately selected depending on the intended purpose. It is preferably 1 μm or less. When the average particle diameter is greater than 1 μm, it may be difficult to control electric resistance.

The resin layer can be formed by dissolving a silicone resin, etc. in a solvent so as to prepare a coating solution, then applying the coating solution over the surface of the core material by a known coating method and drying the coating solution, followed by firing. Examples of the coating method include immersion coating, spraying, and coating with the use of a brush. The solvent is not particularly limited and may be appropriately selected depending on the intended purpose. Examples thereof include toluene, xylene, methyl ethyl ketone, methyl isobutyl ketone and butyl cellosolve acetate. The firing may be based upon external heating or internal heating and may, for example, be carried out in accordance with a method using a stationary electric furnace, a fluid-type electric furnace, a rotary electric furnace, a burner furnace, etc., or a method using a microwave.

The amount of the resin layer included in the carrier is not particularly limited and may be appropriately selected depending on the intended purpose. It is preferably 0.01% by mass to 5.0% by mass. When the amount is less than 0.01% by mass, it may be impossible to form a uniform resin layer on the surface of the core material. When the amount is greater than 5.0% by mass, a thick resin layer is formed, so that carrier particles may fuse with one another and thus the uniformity of the carrier may decrease.

The amount of the carrier included in the two-component developer is not particularly limited and may be appropriately selected depending on the intended purpose. It is preferably 90% by mass to 98% by mass, more preferably 93% by mass to 97% by mass.

(Process Cartridge)

Figure 2:
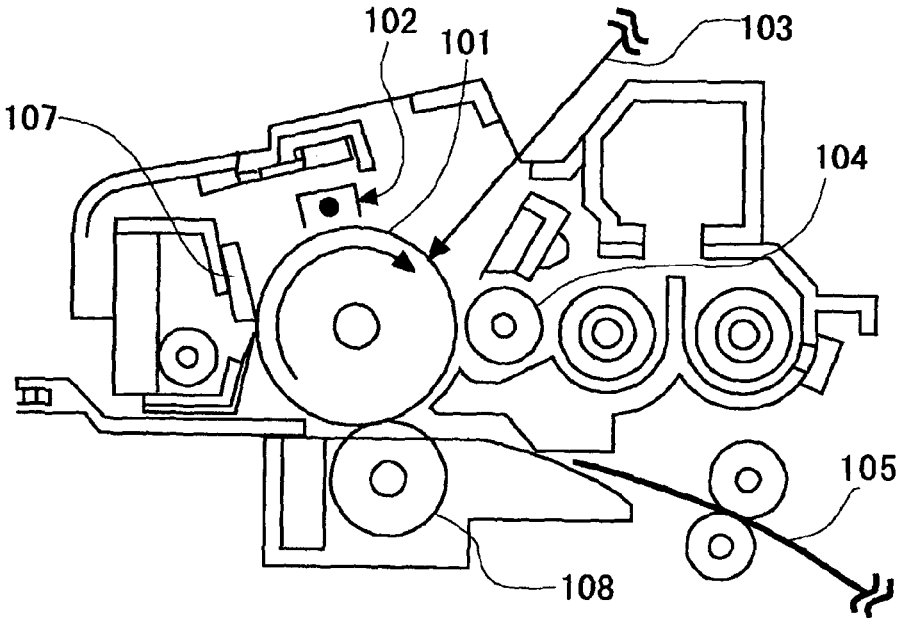
FIG. 2 is a diagram showing a structure of a process cartridge using the toner of the present invention.

FIG. 2 is a diagram showing a structure of a process cartridge using the toner of the present invention.

A process cartridge can be attached to an image forming apparatus, and includes at least: a latent electrostatic image bearing member configured to bear a latent electrostatic image; and a developing unit configured to develop the latent electrostatic image borne on the latent electrostatic image bearing member using a developer, so as to form a visible image, and if necessary further includes a charging unit and a cleaning unit. If necessary, the process cartridge may further include suitably selected other units, such as a charging unit, an exposing unit, a developing unit, a transfer unit, a cleaning unit and a charge eliminating unit.

The developing unit includes at least a developer container which houses the toner and/or the developer of the present invention, and a latent electrostatic image bearing member configured to bear and convey the toner and/or the developer housed in the developer container. Further, the developing unit may include a layer thickness regulating member to regulate the thickness of a toner layer borne.

The process cartridge of the present invention can be detachably attached to an electrophotographic image forming apparatus, a facsimile or a printer and is preferably detachably attached to an image forming apparatus described below.

Here, the process cartridge includes a photoconductor 101, a charging unit 102, a developing unit 104 and a cleaning unit 107 as shown in FIG. 2. If necessary, the process cartridge may further include other members. In the example of the process cartridge shown in FIG. 2, there is provided a transfer unit 108 configured to transfer a developed toner image on the photoconductor 101 to recording medium 105.

As the photoconductor 101, the photoconductor described below may be used.

Exposure 103 is performed using an exposing unit (not shown), which is a light source capable of performing writing with high resolution.

Any charging member may be used as the charging unit 102.

(Image Forming Apparatus)

Figure 3:
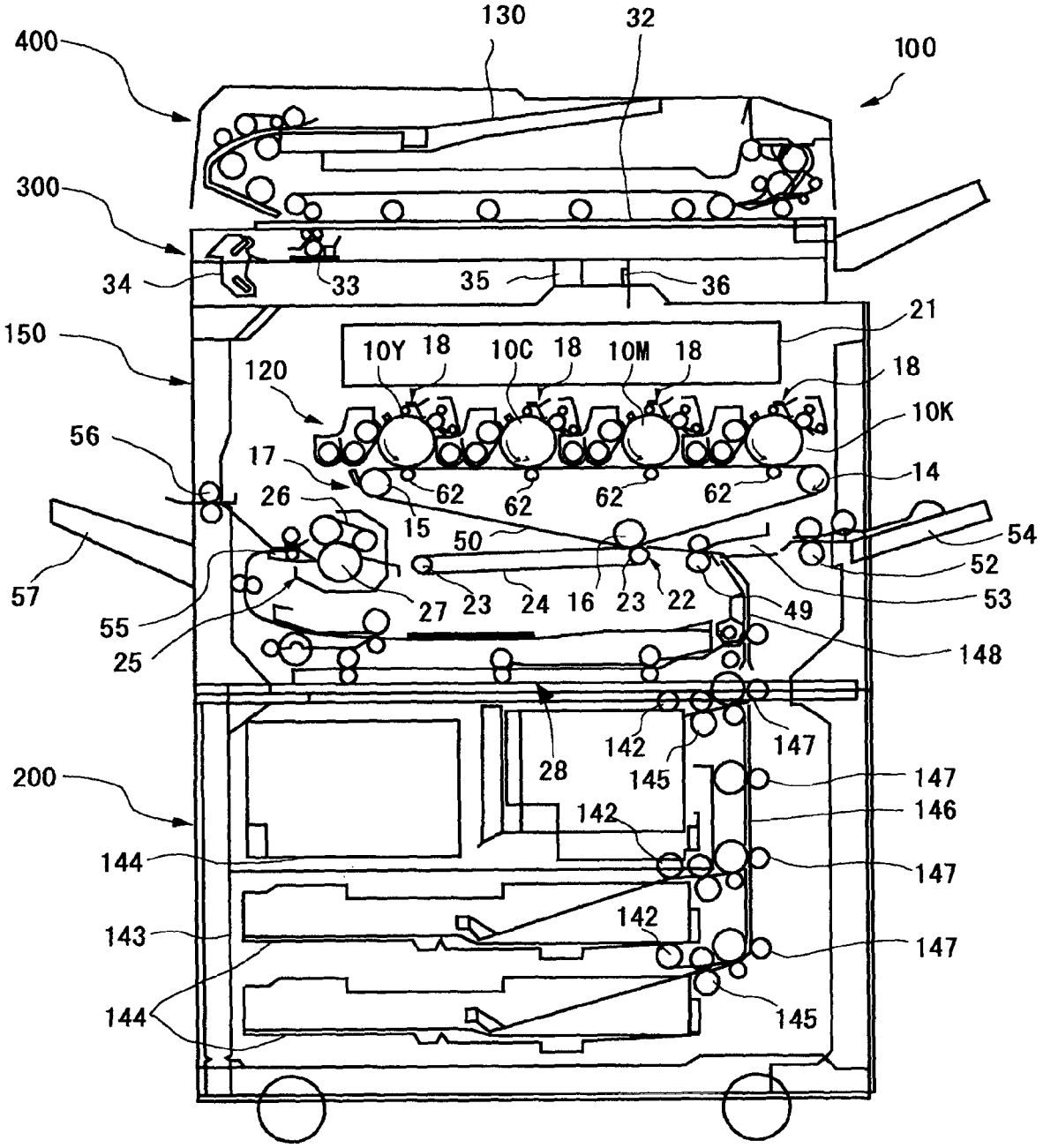
FIG. 3 is a diagram showing a structure of an image forming apparatus using the toner of the present invention.

FIG. 3 is a diagram showing a structure of an image forming apparatus using the toner of the present invention.

The image forming apparatus of the present invention includes at least a latent electrostatic image bearing member, a latent electrostatic image forming unit configured to form a latent electrostatic image on the latent electrostatic image bearing member, a developing unit configured to develop the latent electrostatic image using a toner so as to form a visible image, a transfer unit configured to transfer the visible image onto a recording medium, and a fixing unit configured to fix the transferred image onto the recording medium, and if necessary, further includes appropriately selected other units, such as a charge eliminating unit, a cleaning unit, a recycling unit, and a charge controlling unit.

As a toner a toner of the present invention is used.

The material, shape, structure, and size of the latent electrostatic image bearing member (also referred to as "electrophotographic photoconductor" or "photoconductor") is not particularly limited and may be appropriately selected from those known in the art depending on the intended purpose. For example, the shape is preferably a drum shape. Examples of the materials include inorganic photoconductors such as amorphous silicon and selenium, and organic photoconductors (OPC) such as polysilane and phthalopolymethine.

The latent electrostatic image is formed by uniformly charging a surface of the latent electrostatic image bearing member, and then exposing imagewise the surface of the latent electrostatic image bearing member using the latent electrostatic image forming unit.

The latent electrostatic image forming unit includes at least a charging unit configured to uniformly charge the surface of the latent electrostatic image bearing member, and an exposing unit configured to expose imagewise the surface of the latent electrostatic image bearing member.

The charging may be performed by applying voltage to the surface of the latent electrostatic image bearing member using the charging unit.

The charging unit is not particularly limited and may be appropriately selected depending on the intended purpose. Examples thereof include known contact-chargers equipped with a conductive or semiconductive roller, brush, film or rubber blade, and known non-contact-chargers utilizing corona discharge such as corotron or scorotoron.

It is preferable that the charging unit be placed in contact with or not in contact with the latent electrostatic image bearing member and that a direct and alternating voltages be superimposed and applied to charge the surface of the latent electrostatic image bearing member.

Further, it is also preferred that the charging unit be a charging roller placed close to the latent electrostatic image bearing member in a noncontact manner with a gap tape located in between them, and that the direct and alternating voltages are superimposed and applied to the charging roller so as to charge the surface of the latent electrostatic image bearing member.

The exposure may performed by exposing the surface of the latent electrostatic image bearing member imagewise using the exposing unit.

The exposing unit is not particularly limited and may be appropriately selected depending on the intended purpose, as long as it is capable of exposing imagewise the surface of the latent electrostatic image bearing member which has been charged by the charging unit. Examples thereof include various exposing units such as a copying optical system, a rod lens array system, a laser optical system, and a liquid crystal shutter optical system.

Here, in the present invention, a backlight system for exposing the latent electrostatic image bearing member imagewise from the rear surface thereof may be employed.

The visible image may be formed by developing the latent electrostatic image using the toner of the present invention, and may be performed using the developing unit.

The developing unit is not particularly limited and may be appropriately selected from those known in the art depending on the intended purpose, as long as it is capable of developing an image using the toner of the present invention. For example, a developing unit that includes at least a developing device that contains the toner of the present invention and is capable of supplying the toner to the latent electrostatic image in a contact or noncontact manner is preferable. Moreover, a developing device includes a toner container is more preferable.

The transferring may be performed by the transfer unit, for example, the visible image is transferred by charging the latent electrostatic image bearing member (photoconductor) using a transfer unit. In a preferred embodiment, the transfer unit includes a primary transfer unit configured to transfer the visible image onto an intermediate transfer medium to form a composite transfer image, and a secondary transfer unit configured to transfer the composite transfer image onto a recording medium.

The intermediate transfer medium is not particularly limited and may be appropriately selected from known transfer media depending on the intended purpose, and examples thereof include a transfer belt.

The transfer unit, i.e. the primary transfer unit and the secondary transfer unit, preferably includes at least a transfer device configured to charge so as to separate the visible image formed on the latent electrostatic image bearing member (photoconductor) and transfer the visible image onto the recording medium. One transfer unit or two or more transfer units may be used.

Examples of the transfer devices include corona transfer devices utilizing corona discharge, transfer belts, transfer rollers, pressure-transfer rollers, and adhesion-transfer devices.

The recording medium is not particularly limited and may be appropriately selected from known recording media (recording paper) in the art.

The fixing unit is not particularly limited and may be appropriately selected depending on the intended purpose. A heat-pressure unit known in the art is preferably used. Examples of the heat-pressure units include a combination of a heat roller and a pressure roller, and a combination of a heat roller, a pressure roller and an endless belt.

In the present invention, for example, an optical fixing device known in the art may be used in combination with the fixing unit or instead of the fixing unit, depending on the intended purpose.

When in a heat roller fixing device, a toner and the like adhere to and accumulate on a periphery of a fixing roller, a fixing belt and/or a pressure roller, fixing ability is degraded, and the toner, etc. further accumulates thereon, causing degradation of image quality. Thus, conventionally, various methods for suitably cleaning a periphery of a fixing roller and/or a pressure roller have been proposed. Examples thereof include a roller method in which a cleaning member is brought into contact with a periphery of a fixing roller and/or a pressure roller; a felt method in which a cleaning member formed of felt is slidingly contact with a fixing roller and/or a pressure roller; and a web method, in which a periphery of a fixing roller and/or a pressure roller is cleaned with a web in the process that the web wound around a feeding roller is rolled up using a winding roller. Of these, a mechanism of cleaning a target to be cleaned by bringing it into press-contact with a flexible cleaning web fed from a feeding unit by means of a web pressing member is preferable, because it can constantly maintain cleaning ability. In the present invention, it is preferred that the cleaning device be brought into press-contact with a pressure roller. Upon double face printing, not only does toner offset to the fixing belt occur, but also contamination of fixing roller caused by rubbing an image after fixation occurs. Since the fixing belt is in contact with the pressure roller, and usually temperature of the fixing roller is lower than that of the fixing belt, the toner is solidified and/or becomes highly viscous on the surface of the pressure roller, and then transferred. Thus, the cleaning is efficiently performed on the pressure roller.

The charge eliminating unit is not particularly limited and may be appropriately selected from known charge eliminating devices in the art depending on the intended purpose, as long as it can apply a charge-eliminating bias to the latent electrostatic image bearing member. Examples thereof include a charge eliminating lamp.

The cleaning unit is not particularly limited and may be appropriately selected from known cleaners in the art depending on the intended purpose, as long as it can remove the toner remaining on the latent electrostatic image bearing member. Examples thereof include a magnetic brush cleaner, an electrostatic brush cleaner, a magnetic roller cleaner, a blade cleaner, a brush cleaner, and a web cleaner.

The recycling unit is a unit configured to recycle the toner removed with the cleaning unit to the developing unit, is not particularly limited and may be appropriately selected depending on the intended purpose. Examples thereof include known conveying units.

The controlling unit is configured to control each unit.

The controlling unit is not particularly limited and may be appropriately selected depending on the intended purpose, as long as it is capable of controlling the operations of each of the units. Examples thereof include equipments such as sequencers and computers.

A copier as one example of an electrophotographic image forming apparatus of the present invention will be shown in FIG. 3.

FIG. 3 shows one example of an internal configuration diagram of a color image forming apparatus according to one embodiment of the present invention. This specific example is a tandem indirect-transfer electrophotographic copier, however, the image forming apparatus 100 using the toner of the present invention is not limited thereto.

Numeral 150 denotes a main body of a copier, 200 denotes a paper feeding table on which the copier main body 150 is placed, 300 denotes a scanner (an optical reader) mounted on the copier main body 150 and 400 denotes an automatic document feeder (ADF) mounted on the scanner 300. In the center position of the copier main body 150 an intermediate transfer medium 50 in the form of an endless belt and is extendable in a lateral direction is arranged. As shown in FIG. 3, the intermediate transfer medium 50 is stretched around three support rollers 14, 15 and 16 and rotatable in a clockwise direction. On the left of the second support roller 15 of these three support rollers, an intermediate transfer medium cleaning device 17 is located to remove a residual toner remaining on the intermediate transfer medium 50 after an image is transferred. Above the intermediate transfer medium 50 which is stretched around the first support roller 14 and the second support roller 15, four image forming units 18 for yellow, cyan, magenta and black colors are located side by side along a transport direction of the intermediate transfer medium 50 to form a tandem image forming section 120. Immediately above the tandem image forming section 120, an exposing device 21 is located as shown in FIG. 3. On the side of the intermediate transfer medium 50, which side is opposite to a side where the tandem image forming section 120 is located thereon, a secondary transfer device 22 is located. The secondary transfer device 22 includes an endless secondary transfer belt 24 and two rollers 23, around which the endless secondary transfer belt 24 is stretched, and is pressed against the third support roller 16 via the intermediate transfer medium 50, to thereby transfer an image from the intermediate transfer medium 50 onto a sheet. A fixing device 25, which is configured to fix the transferred image on the sheet, is arranged on the side of the secondary image transfer device 22. The fixing device 25 includes a fixing belt 26 which is an endless belt, and a pressure roller 27 which is pressed against the fixing belt 26. The secondary transfer device 22 also has a function of conveying the sheet, on which an image is transferred, to the fixing device 25. In FIG. 3, below the secondary transfer device 22 and the fixing device 25, a sheet reverser 28 reversing the sheet to form images on both sides thereof is located in parallel with the tandem image forming section 120.

When this color electrophotographic image forming apparatus is used to make a copy, a document is placed on a document platen 130 of the automatic document feeder 400. Alternatively, the automatic document feeder 400 is opened, a document is placed on a contact glass 32 of the scanner 300, and the automatic document feeder 400 is closed to press the document. When pushing a start switch (not shown), the document placed on the automatic document feeder 400 is transported onto the contact glass 32. When the document is initially placed on the contact glass 32, by pushing the start switch (not shown), the scanner 300 is immediately driven to operate a first carriage 33 and a second carriage 34. Light is applied from a light source to the document by action of the first carriage 33, and reflected light from the document is further reflected toward the second carriage 34. The reflected light is further reflected by a mirror of the second carriage 34 and passes through an image-forming lens 35 into a read sensor 36 to thereby read the color document (color image). When the start switch (not shown) is pushed, a drive motor (not shown) rotates one of the support rollers 14, 15 and 16 such that the other two rollers are driven to rotate, to rotate and transport the intermediate transfer medium 50. At the same time, each of the image forming units 18 rotates the latent electrostatic image bearing members 10Y, 10C, 10M, 10K and forms a single-color (monochrome) image, i.e., a yellow image, a cyan image, a magenta image and a black image on respective latent electrostatic image bearing members 10Y, 10C, 10M, 10K.

Then, as the intermediate transfer medium 50 is transported, these single-color images are sequentially transferred onto the intermediate transfer medium 50 to form a composite full color image thereon. On the other hand, when the start switch (not shown) is pushed, one of paper feeding rollers 142 of a paper feeding table 200 is selectively rotated to take a sheet out of one of multiple-stage paper cassettes 144 in a paper bank 143. A separation roller 145 separates sheets one by one and feed the sheet into a paper feeding route 146, and a feeding roller 147 feeds the sheet into a paper feeding route 148 of the copier main body 150 to be stopped against a registration roller 49. Then, the registration roller 49 is rotated synchronously with the movement of the synthesized full-color image on the intermediate transfer medium 50 to feed the sheet between the intermediate transfer medium 50 and the second transfer device 22, and the secondary image transfer device 22 transfers the full-color image onto the sheet.

The sheet on which the full-color image is transferred is fed by the second transfer device 22 to the fixing device 25. The fixing device 25 fixes the image thereon by application of heat and pressure, and the direction of the sheet is changed by action of a switching claw 55, and then the sheet is ejected by an ejection roller 56 onto a paper output tray 57. Alternatively, the moving direction of the sheet is changed by the switching claw 55, and the sheet is fed to the sheet reverser 28, followed by reversing and guiding the sheet again to a transfer position to form an image on the backside of the sheet, and then the sheet is ejected by the ejection roller 56 onto the paper output tray 57. Meanwhile, the intermediate transfer medium 50 after an image has been transferred is cleaned by the intermediate transfer medium cleaning device 17 to remove a residual toner thereon after the image has been transferred, and is ready for another image formation in the tandem image forming section 120.

In the above-mentioned tandem image forming section 120, each of the image forming units 18 includes a charging device, a developing device, a primary image transfer device 62, a charge eliminating device, etc. around each of the drum-shaped photoconductors 10Y, 10C, 10M, 10K.

EXAMPLES

Hereinafter, Examples of the present invention will be described. It should, however, be noted that the present invention is not confined thereto. In Examples, the term "part(s)" and the "%" are both based upon mass, and the term "mol" denotes a molar ratio.

First, a method for measuring various physical properties of materials used and a toner obtained in Examples and Comparative Examples will be described.

<Volume Average Particle Diameter Dv of Toner, Number Average Particle Diameter Dn of Toner, and Ratio Dv/Dn of Toner>

A volume average particle diameter Dv, a number average particle diameter Dn, and a ratio Dv/Dn of the volume average particle diameter to the number average particle diameter of the toner were measured using a particle size measurement device MULTISIZER III, manufactured by Beckman Coulter Inc. with an aperture diameter of 100 μm, and then analyzed by using analysis software (Beckman Coulter MULTISIZER 3 VERSION 3.51). Specifically, in a 100 mL glass beaker, 0.5 mL of 10% of a surfactant (alkylbenzene sulfonate, NEOGEN SC-A, manufactured by Dai-ichi Kogyo Seiyaku Co., Ltd.) was added, 0.5 g of each toner was added thereto, and the toner was mixed with the surfactant using a micro spatula. Next, 80 mL of ion-exchanged water was added thereto. The obtained dispersion liquid was subjected to dispersion treatment in an ultrasonic dispersing device (W-113MK-II, manufactured by Honda Electronics Co., Ltd.) for 10 minutes. The volume average particle diameter Dv, the number average particle diameter Dn, and the ratio Dv/Dn of the volume average particle diameter to the number average particle diameter of the toner were measured using the MULTISIZER III with the use of ISOTON III, manufactured by Beckman Coulter Inc. as a solution for measurement. The dispersion liquid of the toner sample was added dropwise in the device such that the concentration indicated by the device became 8%±2%. In this measurement, from the perspective of measurement reproducibility of particle diameter, it is important that the concentration of the toner sample dispersion liquid was adjusted to 8%±2%. Within this concentration range, no error occurred in the particle diameter.

<Proportion of Toner Particles Containing Voids Having Diameters D1 and D2>

An epoxy resin was added dropwise to a stub specialized for a field-emission-type electron microscope. Toner particles were applied onto the epoxy resin and left to stand for one day so as to embed and fix the toner particles into the epoxy resin. The epoxy resin at the top of the stub was cut with an ultramicrotome (manufactured by Ultrasonic Co.) so as not to squash voids on the cross-sectional surfaces of the toner particles, to thereby avoid the case that voids cannot be observed because they are squashed and closed by the cutting. The cross-sectional surfaces of the toner particles were coated with carbon, and then 4 visual fields of the cross-sectional surfaces were observed through the field-emission-type electron microscope (ULTRA 55, manufactured by Carl Zeiss) under the following conditions (see FIG. 4). In FIG. 4, a black part shows a void, and a whitish gray part surrounding the black part shows a toner particle.

Measurement Conditions

Acceleration voltage: 10 kV

Measurement magnification: 2,000×

The diameter of the void was calculated from the scales shown in the observation display upon observation at 2,000×. The void was substantially circular in cross section, and thus, the diameter thereof could be easily obtained. However, in the case where the shape of the void was deformed into ellipse, a minor axis of the void was substituted for the diameter.

The number of toner particles observed in each visual field was counted, and then the number of toner particles containing voids each having a diameter D1 of larger than 0.0 μm but 0.5 μm or smaller was counted, to thereby obtain a proportion of the toner particles containing voids. This process was repeated. Finally, the proportions of the toner particles in the 4 visual fields were averaged, to thereby determine the proportion of the toner particles containing voids each having a diameter D1.

Moreover, the number of toner particles observed in each visual field was counted, and then the number of toner particles containing voids each having a diameter D2 of 1.0 μm or larger was counted, to thereby obtain a proportion of the toner particles containing voids. This process was repeated. Finally, the proportions of the toner particles in the 4 visual fields were averaged, to thereby determine the proportion of the toner particles containing voids each having a diameter D2.

<Measurement of Glass Transition Temperature and Melting Point of Toner>

The glass transition temperature Tg and melting point were measured in accordance with the following procedure. As measuring devices, a thermal analysis devices TA-60WS and DSC-60, manufactured by SHIMADZU CORPORATION were used, and the measurement was carried out under the following measurement conditions.

Measurement Conditions

Sample container: aluminum sample pan (with a lid)

Amount of sample: 5 mg

Reference: aluminum sample pan (10 mg of alumina)

Atmosphere: nitrogen (flow rate: 50 ml/min)

Temperature conditions

Initial temperature: 20° C.

Temperature increase rate: 10° C./min

End temperature: 150° C.

Holding time: the temperature was not held.

Temperature decrease rate: 10° C./min

End temperature: 20° C.

Holding time: the temperature was not held.

Temperature increase rate: 10° C./min

End temperature: 150° C.

The measurement results were analyzed using a data analysis software TA-60 ver. 1.52, manufactured by SHIMADZU CORPORATION.

The analysis of a glass transition temperature was performed by appointing a range of ±5° C. around a point showing the maximum peak in the lowest temperature side of DrDSC curve, which was the differential curve of the DSC curve in the second heating, and determining the peak temperature using a peak analysis function of the analysis software. Then, the maximum endotherm temperature of the DSC curve was determined in the range of the above peak temperature +5° C. and −5° C. in the DSC curve using a peak analysis function of the analysis software. The temperature shown here corresponds to Tg of the toner.

The analysis of a melting point was performed by appointing a range of ±5° C. around a point showing the maximum peak in the lowest temperature side of DrDSC curve, which was the differential curve of the DSC curve in the second heating, and determining the peak temperature using a peak analysis function of the analysis software. The temperature shown here corresponds to a melting point of the toner.

The glass transition temperature and the melting point could be distinguished from each other based on the following points: In the case of the glass transition temperature, the DSC curve did not return to the exothermic direction after the absorption of heat; in the case of the melting point, the DSC curve returned to the DSC curve, i.e. base line, before the absorption of heat.

<BET Specific Surface Area of Toner>

The BET specific surface area of the toner particles was measured with an automatic surface area and porosimetry analyzer (TriStar 3000: manufactured by Shimadzu Corporation). Specifically, about 0.5 g of a sample was weighed in a sample cell, and it was vacuum dried using a pretreatment system smartprep (manufactured by Shimadzu Corporation) for 24 hours, and then impurities and water on the sample surface were removed. The pretreated sample was set in TriStar 3000 to obtain the relation between nitrogen gas adsorption and relative pressure. Based on this relation, the BET specific surface area of the sample could be obtained by a multipoint BET method. In the present invention, the BET specific surface area is preferably 1.7 $m^2/g$ to 2.5 $m^2/g$.

<Toner Material Liquid Preparation Step>

—Synthesis of Unmodified Polyester Resin (Low Molecular Weight Polyester Resin) A—

Into a reaction vessel equipped with a condenser tube, a stirrer and a nitrogen-introducing tube, 229 parts of an ethylene oxide (2 mol) adduct of bisphenol A, 529 parts of a propylene oxide (3 mol) adduct of bisphenol A, 208 parts of terephthalic acid, 46 parts of adipic acid and 2 parts of dibutyltin oxide were charged, and the mixture was allowed to react for 8 hours under normal pressure at 230° C. Then, the reaction liquid was further reacted for 5 hours under a reduced pressure of 10 mmHg to 15 mmHg. Thereafter, 44 parts of trimellitic anhydride was charged into the reaction vessel, and then the mixture was allowed to react for 2 hours under normal pressure at 180° C., to thereby synthesize Unmodified Polyester Resin A.

Unmodified Polyester Resin A had a number average molecular weight Mn of 2,500, a weight average molecular weight Mw of 6,700, a glass transition temperature Tg of 47° C. and an acid value of 18 mgKOH/g.

—Synthesis of Unmodified Polyester Resin (Low Molecular Weight Polyester Resin) B—

Into a reaction vessel equipped with a condenser tube, a stirrer and a nitrogen-introducing tube, 344 parts of an ethylene oxide (2 mol) adduct of bisphenol A, 529 parts of a propylene oxide (3 mol) adduct of bisphenol A, 208 parts of terephthalic acid, 46 parts of adipic acid and 2 parts of dibutyltin oxide were charged, and the mixture was allowed to react for 8 hours under normal pressure at 230° C. Then, the reaction liquid was further reacted for 5 hours under a reduced pressure of 10 mmHg to 15 mmHg. Thereafter, 44 parts of trimellitic anhydride was charged into the reaction vessel, and then the mixture was allowed to react for 2 hours under normal pressure at 180° C., to thereby synthesize Unmodified Polyester Resin B.

Unmodified Polyester Resin B had a number average molecular weight Mn of 2,500, a weight average molecular weight Mw of 6,700, a glass transition temperature Tg of 53° C. and an acid value of 18 mgKOH/g.

—Preparation of Masterbatch (MB) A—

Water (600 parts), 400 parts of carbon black (PRINTEX 35, manufactured by Degussa GmbH, DBP oil absorption=42 mL/100 g, pH=9.5) as the colorant, and 600 parts of Unmodified Polyester Resin A were mixed using a HENSCHEL MIXER, manufactured by NIPPON COKE & ENGINEERING COMPANY, LIMITED. The mixture was kneaded at 150° C. for 30 minutes using a two roll mill. Thereafter, the mixture was subjected to rolling and cooling and then pulverized using a pulverizer, manufactured by Hosokawa Micron Corporation, to thereby prepare Masterbatch A.

—Preparation of Masterbatch (MB) B—

Water (420 parts), 400 parts of C. I. Pigment Yellow 74 as the colorant, and 600 parts of Unmodified Polyester Resin A were mixed using a HENSCHEL MIXER, manufactured by NIPPON COKE & ENGINEERING COMPANY, LIMITED. The mixture was kneaded at 150° C. for 30 minutes using a two roll mill. Thereafter, the mixture was subjected to rolling and cooling and then pulverized using a pulverizer, manufactured by Hosokawa Micron Corporation, to thereby prepare Masterbatch B.

—Preparation of Masterbatch (MB) C—

Water (420 parts), 300 parts of C. I. Pigment Red 269 and 100 parts of Pigment Red 122 as the colorants, and 600 parts of the Unmodified Polyester Resin A were mixed using a HENSCHEL MIXER, manufactured by NIPPON COKE & ENGINEERING COMPANY, LIMITED. The mixture was kneaded at 150° C. for 30 minutes using a two roll mill. Thereafter, the mixture was subjected to rolling and cooling and then pulverized using a pulverizer, manufactured by Hosokawa Micron Corporation, to thereby prepare Masterbatch C.

—Preparation of Masterbatch (MB) D—

Water (350 parts), 500 parts of C. I. Pigment Blue 15:3 as the colorant, and 500 parts of Unmodified Polyester Resin A were mixed using a HENSCHEL MIXER, manufactured by NIPPON COKE & ENGINEERING COMPANY, LIMITED. The mixture was kneaded at 150° C. for 30 minutes using a two roll mill. Thereafter, the mixture was subjected to rolling and cooling and then pulverized using a pulverizer, manufactured by Hosokawa Micron Corporation, to thereby prepare Masterbatch D.

—Synthesis of Wax Dispersant—

In an autoclave reaction vessel equipped with a thermometer and a stirrer, 600 parts of xylene and 300 parts of low-molecular-weight polyethylene (SANWAX LEL-400, manufactured by Sanyo Chemical Industries, Ltd.; a ½ method softening point: 128° C.) were charged, and the polyethylene was sufficiently dissolved into the xylene, followed by nitrogen substitution. Thereafter, a mixed solution of 2,310 parts of styrene, 270 parts of acrylonitrile, 150 parts of butyl acrylate, 78 parts of di-t-butylperoxyhexahydroterephthalate and 455 parts of xylene was added dropwise at 175° C. for 3 hours, so as to effect polymerization, and the mixture was further held at 175° C. for 30 minutes. Subsequently, the solvent was removed from the mixture, to thereby obtain a wax dispersant.

—Preparation of Wax Dispersion Liquid 1—

Into a reaction vessel equipped with a stirring rod and a thermometer, 378 parts of Unmodified Polyester Resin A, 110 parts of Wax A (microcrystalline wax, BE Square 180 white, manufactured by TOYO ADL CORPORATION; a melting point: 67° C.), 66 parts of the wax dispersant, and 947 parts of ethyl acetate were charged, heated to 80° C. with stirring, held at 80° C. for 5 hours, and cooled to 30° C. for 1 hour, to thereby obtain Wax Dispersion Liquid 1.

—Preparation of Wax Dispersion Liquid 2—

Wax Dispersion Liquid 2 was produced in the same manner as in the preparation of Wax Dispersion Liquid 1, except that Wax A was replaced with Wax B (polyethylene wax, CRAYVALLAC WN-1442, manufactured by CRAY VALLEY; a melting point: 82° C.; a penetration of wax at 43.3° C.: 29 mm; a viscosity at 140° C.: 7.5 mPa·s; a mass decrease at 165° C.: 3.5%).

—Preparation of Wax Dispersion Liquid 3—

Wax Dispersion Liquid 3 was produced in the same manner as in the preparation of Wax Dispersion Liquid 1, except that Wax A was replaced with Wax C (paraffin wax HNP-9, manufactured by NIPPON SEIRO CO., LTD.; a melting point: 78° C.; a mass decrease at 165° C.; 12%).

—Synthesis of Prepolymer 1—

Into a reaction vessel equipped with a condenser tube, a stirrer and a nitrogen-introducing tube, 682 parts of an ethylene oxide (2 mol) adduct of bisphenol A, 81 parts of a propylene oxide (2 mol) adduct of bisphenol A, 283 parts of terephthalic acid, 22 parts of trimellitic anhydride and 2 parts of dibutyltin oxide were charged, and the mixture was allowed to react for 7 hours under normal pressure at 230° C., then to further react for 5 hours under a reduced pressure of 10 mmHg to 15 mmHg, to thereby obtain Intermediate Polyester 1. Intermediate Polyester 1 had a number average molecular weight of 2,200, a weight average molecular weight of 9,700, a peak molecular weight of 3,000, a Tg of 54° C., an acid value of 0.5 mgKOH/g and a hydroxyl value of 52 mgKOH/g.

Next, into a reaction vessel equipped with a condenser tube, a stirrer and a nitrogen-introducing tube, 410 parts of Intermediate Polyester 1, 89 parts of isophorone diisocyanate and 500 parts of ethyl acetate were charged, and the mixture was allowed to react at 100° C. for 5 hours, to thereby obtain Prepolymer 1. Prepolymer 1 had a weight average molecular weight of 36,500. Prepolymer 1 had a free isocyanate content of 1.53% and a solid content of 49.1%.

—Synthesis of Prepolymer 2—

Into a reaction vessel equipped with a condenser tube, a stirrer and a nitrogen-introducing tube, 682 parts of an ethylene oxide (2 mol) adduct of bisphenol A, 81 parts of a propylene oxide (2 mol) adduct of bisphenol A, 283 parts of terephthalic acid, 26 parts of trimellitic anhydride and 2 parts of dibutyltin oxide were charged, and the mixture was allowed to react for 7 hours under normal pressure at 230° C., then to further react for 5 hours under a reduced pressure of 10 mmHg to 15 mmHg, to thereby obtain Intermediate Polyester 2. Intermediate Polyester 2 had a number average molecular weight of 2,200, a weight average molecular weight of 9,700, a peak molecular weight of 3,000, a Tg of 54° C., an acid value of 0.5 mgKOH/g and a hydroxyl value of 62 mgKOH/g.

Next, into a reaction vessel equipped with a condenser tube, a stirrer and a nitrogen-introducing tube, 410 parts of Intermediate Polyester 2, 89 parts of isophorone diisocyanate and 500 parts of ethyl acetate were charged, and the mixture was allowed to react at 100° C. for 5 hours, to thereby obtain Prepolymer 2. Prepolymer 2 had a weight average molecular weight of 39,000, a free isocyanate content of 1.53% and a solid content of 49.1%.

Example 1

Preparation of Organic Solvent Phase

A raw material solution was obtained by mixing 2,493 parts of Wax Dispersion Liquid 1, 500 parts of Masterbatch B and 1,012 parts of ethyl acetate for 1 hour.

Then, 1,324 parts of the raw material solution was moved into a reaction vessel. Subsequently, using a bead mill (ULTRA VISCOMILL, manufactured by AIMEX CO., Ltd.), the raw material solution was passed three times under the following conditions so as to disperse the carbon black and the wax: the liquid feed rate was 1 kg/hr, the disc circumferential velocity was 6 m/sec, and 0.5 mm-zirconia bead packed to 80% by volume. Subsequently, 1,324 parts of a 65% of ethyl acetate solution of Unmodified Polyester Resin A was added to the obtained dispersion liquid and passed through the bead mill once under the conditions described above, to thereby prepare an organic solvent phase.

The organic solvent phase had a solid content concentration of 50% under the measurement conditions of heating for 30 minutes at 130° C.

—Synthesis of Ketimine (Active Hydrogen Group-Containing Compound)—

Into a reaction vessel equipped with a stirring rod and a thermometer, 170 parts of isophoronediamine and 75 parts of methyl ethyl ketone were charged, and the mixture was allowed to react at 50° C. for 5 hours, to thereby synthesize a ketimine compound (active hydrogen group-containing compound).

The ketimine compound (active hydrogen group-containing compound) had an amine value of 418 mgKOH/g.

—Preparation of Toner Material Liquid—

In a reaction vessel, 749 parts of the organic solvent phase, 115 parts of Prepolymer 1, 2.9 parts of the ketimine compound and 0.4 parts of a tertiary amine compound (U-CAT660M, manufactured by Sanyo Chemical Industries, Ltd.) were charged, and the mixture was mixed at 7.5 m/s for 1 minute using T. K. HOMO MIXER (manufactured by Tokushu Kika Kogyo Co., Ltd.), to thereby prepare a toner material liquid.

—Preparation of Organic Resin Fine Particle Dispersion Liquid—

Into a reaction vessel equipped with a stirring rod and a thermometer, 683 parts of water, 20 parts of a sodium salt of methacrylic acid ethylene oxide adduct sulfate, ELEMINOL RS-30, manufactured by Sanyo Chemical Industries, Ltd., 78 parts of styrene, 78 parts of methacrylic acid, 120 parts of butyl acrylate and 1 part of ammonium persulfate were charged, and then stirred for 15 minutes at 400 rpm to thereby obtain a white emulsion. The emulsion was heated such that the system temperature reached 75° C., and the emulsion was subjected to reaction for 5 hours. Subsequently, 30 parts of a 1% aqueous ammonium persulfate solution was added, then aged at 75° C. for 5 hours, to thereby prepare an aqueous dispersion liquid (organic resin fine particle dispersion liquid) of vinyl resin particles (a copolymer of styrene-methacrylic acid-butyl acrylate-sodium salt of methacrylic acid ethylene oxide adduct sulfate).

The volume average particle diameter Dv of organic resin fine particles contained in the organic resin fine particle dispersion liquid was 55 nm, as measured with a particle size distribution measuring apparatus NANOTRAC UPA-150EX, manufactured by NIKKISO CO., LTD. Further, part of the organic resin fine particle dispersion liquid was dried to thereby isolate a resin content, and the resin content had a glass transition temperature Tg of 48° C. and a weight average molecular weight Mw of 450,000.

—Preparation of Aqueous Medium—

Water (990 parts), 37 parts of a 48.5% aqueous solution of sodium dodecyldiphenyl ether disulfonate ELEMINOL MON-7, manufactured by Sanyo Chemical Industries, Ltd. as a surfactant, 15 parts of the organic resin fine particle dispersion liquid and 90 parts of ethyl acetate were mixed and stirred, to thereby obtain an opaque white liquid. This was defined as an aqueous medium.

<Toner Forming Step>

—Emulsification or Dispersion—

Into 1,200 parts of the aqueous medium the toner material liquid was added, and then mixed at a circumferential velocity of 15 m/s for 20 minutes using T. K. HOMO MIXER (manufactured by Tokushu Kika Kogyo Co., Ltd.), to thereby prepare an oil-in-water dispersion liquid (emulsified slurry). Thereafter, using a Three-One Motor equipped with a blade, the dispersion liquid was stirred at 300 rpm for 30 minutes, so that the emulsified particles were agglomerated. The obtained particles had a volume average particle diameter Dv of 5 μm and Dv/Dn of 1.15, as measured with MULTISIZER III.

—Step of Removal of Organic Solvent and Aging—

The obtained slurry was moved to a recovery flask, and the solvent was removed from the slurry at room temperature using an evaporator. Thereafter, the slurry was charged into a reaction vessel equipped with a stirrer and a thermometer, and aged at 45° C. for 4 hours.

—Removal of Surfactant by Washing—

The aged slurry (100 parts) was subjected to centrifugal filtration, then 100 parts of ion-exchanged water was added to the obtained filter cake, and the mixture was mixed using T. K. HOMO MIXER at a rotational speed of 10.0 m/s for 10 minutes, followed by filtering. To the obtained filter cake 100 parts of ion-exchanged water was added, and the mixture was mixed using T. K. HOMO MIXER at a rotational speed of 10.0 m/s for 10 minutes, and then subjected to centrifugal filtration. To the obtained filter cake, 100 parts of 10% aqueous sodium hydroxide solution was added, and the mixture was mixed using T. K. HOMO MIXER at a rotational speed of 10.0 m/s for 10 minutes, and then subjected to centrifugal filtration. To the obtained filter cake 300 parts of ion-exchanged water was added, and the mixture was mixed using T. K. HOMO MIXER at a rotational speed of 10.0 m/s for 10 minutes, and then subjected to centrifugal filtration, and this procedure was performed twice. To the obtained filter cake 300 parts of ion-exchanged water was added, and the mixture was mixed using T. K. HOMO MIXER at a rotational speed of 10.0 m/s for 10 minutes, and then with 10% hydrochloric acid solution the pH of the mixture was adjusted to 4. Thereafter, the mixture was stirred for 1 hour, and subjected to centrifugal filtration. To the obtained filter cake 300 parts of ion-exchanged water was added, and the mixture was mixed using T. K. HOMO MIXER at a rotational speed of 10.0 m/s for 10 minutes, and then subjected to centrifugal filtration, and this procedure was performed twice, to thereby obtain a final filter cake.

—Heating after Removal of Surfactant—

Ion-exchanged water (300 parts) was added to the resultant final filter cake, to be formed into a slurry. The slurry was heated at 55° C. for 30 minutes while stirring, and then filtered under reduced pressure.

—Drying—

The obtained final filter cake was dried at 45° C. for 48 hours using an air circulating dryer and then sieved through a mesh having 75 μm-opening, to thereby obtain toner base particles of Example 1. The toner base particles of Example 1 had a volume average particle diameter of 5.4 μm, and a BET specific surface area of 2.2 $m^2/g$.

—Treatment with External Additive—

Using a HENSCHEL MIXER, manufactured by NIPPON COKE & ENGINEERING COMPANY LIMITED, 1.5 parts of hydrophobic silica, and 0.5 parts of hydrophobized titanium oxide, which served as external additives, were mixed with 100 parts of the toner base particles of Example 1, and then the mixture was sieved using a mesh having 35 μm-opening, to thereby produce a toner of Example 1.

Example 2

Toner base particles were produced in the same manner as in Example 1, except that the heat temperature of the slurry after the removal of the surfactant was changed from 55° C. to 50° C. The toner base particles had a volume average particle diameter of 5.4 μm and a BET specific surface area of 2.4 $m^2/g$. Then, the toner base particles were treated with the external additive in the same manner as in Example 1, to thereby obtain a toner of Example 2.

Example 3

Toner base particles were produced in the same manner as in Example 1, except that Unmodified Polyester Resin A was replaced with Unmodified Polyester Resin B in the preparation of the organic solvent phase. The toner base particles had a volume average particle diameter of 5.4 μm and a BET specific surface area of 2.3 $m^2/g$. Then, the toner base particles were treated with the external additive in the same manner as in Example 1, to thereby obtain a toner of Example 3.

Example 4

Toner base particles were produced in the same manner as in Example 3, except that the heat temperature of the slurry after the removal of the surfactant was changed from 55° C. to 60° C. The toner base particles having a volume average particle diameter of 5.4 μm and a BET specific surface area of 2.1 $m^2/g$. Then, the toner base particles were treated with the external additive in the same manner as in Example 1, to thereby obtain a toner of Example 4.

Example 5

Toner base particles were produced in the same manner as in Example 2, except that the heating time of the slurry after the removal of the surfactant was changed from 30 minutes to 10 minutes. The toner base particles had a volume average particle diameter of 5.4 μm and a BET specific surface area of 2.4 $m^2/g$. Then, the toner base particles were treated with the external additive in the same manner as in Example 1, to thereby obtain a toner of Example 5.

Example 6

Toner base particles were produced in the same manner as in Example 2, except that the heating time of the slurry after the removal of the surfactant was changed from 30 minutes to 5 minutes. The toner base particles had a volume average particle diameter of 5.4 μm and a BET specific surface area of 2.4 $m^2/g$. Then, the toner base particles were treated with the external additive in the same manner as in Example 1, to thereby obtain a toner of Example 6.

Example 7

Toner base particles were produced in the same manner as in Example 1, except that Wax Dispersion Liquid 1 was replaced with Wax Dispersion Liquid 2. The toner base particles had a volume average particle diameter of 5.3 μm and a BET specific surface area of 2.2 $m^2/g$. Then, the toner base particles were treated with the external additive in the same manner as in Example 1, to thereby obtain a toner of Example 7.

Example 8

Toner base particles were produced in the same manner as in Example 1, except that Wax Dispersion Liquid 1 was replaced with Wax Dispersion Liquid 3. The toner base particles had a volume average particle diameter of 5.3 μm and a BET specific surface area of 2.2 $m^2/g$. Then, the toner base particles were treated with the external additive in the same manner as in Example 1, to thereby obtain a toner of Example 8.

Example 9

Toner base particles were produced in the same manner as in Example 1, except that Masterbatch B was replaced with Masterbatch A in the preparation of the organic solvent phase. The toner base particles had a volume average particle diameter of 5.3 μm and a BET specific surface area of 2.1 $m^2/g$. Then, the toner base particles were treated with the external additive in the same manner as in Example 1, to thereby obtain a toner of Example 9.

Example 10

Toner base particles were produced in the same manner as in Example 1, except that Masterbatch B was replaced with Masterbatch C in the preparation of the organic solvent phase. The toner base particles had a volume average particle diameter of 5.3 μm and a BET specific surface area of 2.2 $m^2/g$. Then, the toner base particles were treated with the external additive in the same manner as in Example 1, to thereby obtain a toner of Example 10.

Example 11

Toner base particles were produced in the same manner as in Example 1, except that Masterbatch B was replaced with Masterbatch D in the preparation of the organic solvent phase.

The toner base particles had a volume average particle diameter of 5.3 μm and a BET specific surface area of 2.1 $m^2/g$. Then, the toner base particles were treated with the external additive in the same manner as in Example 1, to thereby obtain a toner of Example 11.

Example 12

Toner base particles were produced in the same manner as in Example 2, except that Masterbatch B was replaced with Masterbatch C in the preparation of the organic solvent phase. The toner base particles had a volume average particle diameter of 5.3 μm and a BET specific surface area of 2.3 $m^2/g$. Then, the toner base particles were treated with the external additive in the same manner as in Example 1, to thereby obtain a toner of Example 12.

Example 13

Toner base particles were produced in the same manner as in Example 2, except that Prepolymer 1 was replaced with Prepolymer 2 in the preparation of the toner material liquid. The toner base particles had a volume average particle diameter of 5.3 μm and a BET specific surface area of 2.4 $m^2/g$. Then, the toner base particles were treated with the external additive in the same manner as in Example 1, to thereby obtain a toner of Example 13.

Example 14

Toner base particles were produced in the same manner as in Example 1, except that the heating time of the slurry after the removal of the surfactant was changed from 30 minutes to 5 minutes. The toner base particles had a volume average particle diameter of 5.4 μm and a BET specific surface area of 2.4 $m^2/g$. Then, the toner base particles were treated with the external additive in the same manner as in Example 1, to thereby obtain a toner of Example 14.

Example 15

Toner base particles were produced in the same manner as in Example 12, except that the heating time of the slurry after the removal of the surfactant was changed from 30 minutes to 5 minutes. The toner base particles had a volume average particle diameter of 5.3 μm and a BET specific surface area of 2.3 $m^2/g$. Then, the toner base particles were treated with the external additive in the same manner as in Example 1, to thereby obtain a toner of Example 15.

Comparative Example 1

Toner base particles were produced in the same manner as in Example 1, except that the heat temperature of the slurry after the removal of the surfactant was changed from 55° C. to 45° C. The toner base particles had a volume average particle diameter of 5.4 μm and a BET specific surface area of 2.9 $m^2/g$. Then, the toner base particles were treated with the external additive in the same manner as in Example 1, to thereby obtain a toner of Comparative Example 1.

Comparative Example 2

Toner base particles were produced in the same manner as in Example 1, except that the heat temperature of the slurry after the removal of the surfactant was changed from 55° C. to 65° C. The toner base particles had a volume average particle diameter of 5.3 μm and a BET specific surface area of 1.6 $m^2/g$. Then, the toner base particles were treated with the external additive in the same manner as in Example 1, to thereby obtain a toner of Comparative Example 2.

Comparative Example 3

Toner base particles were produced in the same manner as in Example 1, except that the slurry after the removal of the surfactant was not heated. The toner base particles had a volume average particle diameter of 5.4 μm and a BET specific surface area of 3.0 $m^2/g$. Then, the toner base particles were treated with the external additive in the same manner as in Example 1, to thereby obtain a toner of Comparative Example 3.

<Production of Developer>

A developer was produced by mixing 7 parts of the produced toner and 93 parts of a carrier produced in the following manner, and stirred using a tubular mixer.

—Production of Carrier—

To 100 parts of toluene 100 parts of a silicone resin (organo straight silicone), 5 parts of γ-(2-aminoethyl)aminopropyltrimethoxysilane, and 10 parts of carbon black were added, and the mixture was dispersed for 20 minutes using a homo mixer, to thereby prepare a resin layer coating liquid. Using a fluidized bed coating apparatus, the resin layer coating liquid was applied to particle surfaces of 1,000 parts of a spherical-shaped magnetite having an average particle diameter of 50 μm, to thereby produce a carrier.

Next, using the developer, the resistance to smear, the lower limit fixing temperature of a half tone image, the transfer rate, and the granular smear were evaluated. The results are shown in Table 1.

<Resistance to Smear>

A fixing portion of the copier MF-200 (manufactured by Ricoh Company, Ltd.) employing a TEFLON roller as a fixing roller was modified to produce a modified copier. The above-produced developer and Type 6200 paper sheets (manufactured by Ricoh Company, Ltd.) were set in the modified copier, and printing was performed so as to develop 0.20 $mg/cm^2 \pm 0.01$ $mg/cm^2$ of a toner while changing the temperature of the fixing roller in 5° C. steps.

A white cotton cloth in a size of about 25 mm×25 mm (JIS L0823 cotton No. 3) was attached to a friction block of a smear tester (friction tester I type, JIS L0823, the diameter of the friction block: 15 mm) with a double-faced tape, so that the direction of the fiber of the cloth became horizontal to the moving direction of the friction block. Then, the fixed image was abraded by means of five times of continuous reciprocating motion using the friction block. Thereafter, the white cotton cloth was separated, and any three points of the image density of the fixed image, where the trace of the friction block remained, were measured using a spectrometer (938 Spectrodensitometer, manufactured by X-Rite), and averaged the resultant values, to thereby obtain smear ID. The resistance to smear was evaluated based on the fixing temperature when the smear ID was 0.3 or less. The lower the fixing temperature was, the more excellent the resistant to smear was.

In the case where the double face printing was performed, when the lower limit fixing temperature of the resistance to smear was high, toner offset caused by rubbing a fixed image on the pressure roller increased. Thus, the image smear (granular smear described below) caused by adhesion of the offset toner was likely to occur.

The lower limit fixing temperature of the resistance to smear was preferably low, for suppressing electric power consumption, and securing image quality as described above. When the lower limit fixing temperature of the resistance to smear was 145° C. or lower, there was no problem in practical use.

<Transfer Rate>

A black solid image in a size of 15 cm×15 cm having an average image density of 1.38 or higher as measured with a Macbeth reflection densitometer, was formed on a paper sheet, My Recycle Paper 100 using an image forming apparatus MF2800, manufactured by Ricoh Company, Ltd., and then a transfer rate of the toner was obtained by the following Equation 1.

$$\text{Transfer rate (\%)} = (\text{amount of toner transferred onto a recording medium/amount of toner developed on a photoconductor}) \times 100 \quad \text{Equation 1}$$

The transfer rate was evaluated based on the following evaluation criteria.

Evaluation Criteria

A: The transfer rate was 90% or more.

B: The transfer rate was 80% or more but less than 90%.

C: The transfer rate was less than 80%.

<Lower Limit Fixing Temperature of Half Tone Image>

A fixing portion of the copier MF-200 (manufactured by Ricoh Company, Ltd.) employing a TEFLON roller as a fixing roller was modified to produce a modified copier. A half tone image formed on a paper sheet, Type 6000 <70 W> (manufactured by Ricoh Company, Ltd.) was fixed while changing the temperature of the fixing roller in 5° C. steps. The temperature at which no offset occurred was determined as the lower limit fixing temperature of the half tone image.

When the lower limit fixing temperature of the half tone image became high, the amount of the offset toner increased on the fixing belt, and image smear (granular smear) occurred due to adhesion of the offset toner. The reason for performing evaluation with the half tone image was that the toner of the half tone image was easily removed from the paper, and easiness of occurring offset upon image fixation was evaluated at an accelerating rate, since toner particles were less fused with each other in a half tone image, compared to those in a solid image.

The lower limit fixing temperature of the half tone image was preferably low, for suppressing electric power consumption, and securing image quality as described above. When the lower limit fixing temperature of the half tone image was 145° C. or lower, there was no problem in practical use.

<Granular Smear>

A cleaning member for a pressure member of a fixing device in an image forming apparatus, IMAGIO MPC5000 (manufactured by Ricoh Company, Ltd.) was changed to a cleaning web. Using the image forming apparatus, half tone images were formed on 10,000 sheets, and further formed on 100 sheets. Thereafter, the half tone image was formed on a sheet, and then a granular smear on the sheet was visually evaluated. The evaluation criteria of the granular smear were as follows.

A: No granular smear occurred.

B: Small amount of granular smears occurred.

C: Aggregation of granular smears occurred.

As described above, when the resistance to smear was low, or toner offset was easily occurred upon the image fixation, the amount of the toner adhesion to the cleaning web increased. In the case where the amount of the toner adhesion exceeded the cleaning ability of the web, the toner which had not been cleaned adhered to a recording medium, and then the granular smear occurred.

TABLE 1

| | Proportion of toner particles containing voids having a diameter D1 (%) | Proportion of toner particles containing voids having a diameter D2 (%) | BET specific surface area ($m^2/g$) | Resistance to smear | Lower limit fixing temperature of half tone image | Glass transition temperature of toner (° C.) | Transfer rate | Granular smear |
|---|---|---|---|---|---|---|---|---|
| Ex. 1 | 55 | 5 | 2.2 | 140 | 140 | 47 | A | A |
| Ex. 2 | 15 | 1 | 2.4 | 135 | 135 | 47 | B | A |
| Ex. 3 | 40 | 3 | 2.3 | 140 | 140 | 53 | B | A |
| Ex. 4 | 60 | 5 | 2.1 | 140 | 140 | 53 | A | A |
| Ex. 5 | 10 | 0 | 2.4 | 135 | 135 | 47 | B | A |
| Ex. 6 | 10 | 0 | 2.4 | 135 | 135 | 47 | B | A |
| Ex. 7 | 58 | 5 | 2.2 | 140 | 140 | 47 | B | A |
| Ex. 8 | 57 | 4 | 2.2 | 140 | 140 | 47 | B | A |
| Ex. 9 | 20 | 1 | 2.1 | 135 | 135 | 47 | A | A |
| Ex. 10 | 55 | 10 | 2.2 | 140 | 145 | 47 | B | B |
| Ex. 11 | 20 | 1 | 2.1 | 135 | 135 | 47 | A | A |
| Ex. 12 | 52 | 8 | 2.3 | 135 | 140 | 47 | B | A |
| Ex. 13 | 55 | 5 | 2.4 | 145 | 145 | 47 | B | B |
| Ex. 14 | 52 | 3 | 2.4 | 140 | 140 | 47 | B | A |
| Ex. 15 | 50 | 5 | 2.3 | 135 | 140 | 47 | B | A |
| Comp. Ex. 1 | 5 | 0 | 2.9 | 140 | 140 | 47 | C | A |
| Comp. Ex. 2 | 90 | 17 | 1.6 | 155 | 155 | 47 | A | C |
| Comp. Ex. 3 | 0 | 0 | 3.0 | 130 | 130 | 47 | C | A |

As can be seen from Table 1, the resistance to smear, etc. was influenced by the size of the voids contained in the toner, and the proportions of the toner particles containing voids having diameters D1 and D2.

It was found that the toners of Examples 1 to 15, in which the proportion of the toner particles containing voids each having a diameter D1 was more than 5.0% to 60%, and the proportion of the toner particles containing voids each having a diameter D2 was 10% or less, could improve the resistance to smear, the granular smear, and the transfer rate of the toner, in comparison with Comparative Examples 1 to 3.

REFERENCE SIGNS LIST

10K latent electrostatic image bearing member (photoconductor) for black

10Y latent electrostatic image bearing member (photoconductor) for yellow

10M latent electrostatic image bearing member (photoconductor) for magenta

10C latent electrostatic image bearing member (photoconductor) for cyan

14, 15, 16 support roller
17 intermediate transfer medium cleaning device
18 image forming unit
21 exposing device
22 secondary transfer device
24 secondary transfer belt
25 fixing device
26 fixing belt
27 pressure roller
28 sheet reverser
32 contact glass
33 first carriage
34 second carriage
35 image-forming lens
36 read sensor
49 registration roller
50 intermediate transfer medium
52 separation roller
53 manual feed path
54 manual feed tray
55 switching claw
56 ejection roller
57 paper output tray
62 primary image transfer device
100 image forming apparatus
101 latent electrostatic image bearing member (photoconductor)
102 charging unit
103 exposing unit
104 developing unit
105 recording medium
107 cleaning unit
108 transfer unit
120 tandem image forming section
130 document platen
142 paper feeding rollers
143 paper bank
144 paper cassettes
145 separation roller
146 paper feeding route
147 feeding roller
148 paper feeding route
150 copier main body
200 paper feeding table
300 scanner
400 automatic document feeder (ADF)

The invention claimed is:

1. A toner, comprising:
toner particles comprising:
a binder resin;
a colorant; and
a releasing agent,
wherein
a proportion of the toner particles comprising a void having a diameter D1 of larger than 0.0 μm and no more than 0.5 μm is more than 5.0% and no more than 60%,
a proportion of the toner particles comprising a void having a diameter D2 of 1.0 μm or larger is 10% or less, and
a cross-sectional shape of the void is substantially circular or elliptical.

2. The toner according to claim 1, obtained by a process comprising:
dissolving or dispersing a toner material in an organic solvent, thereby obtaining an oil phase;
emulsifying or dispersing the oil phase in an aqueous medium, thereby obtaining an emulsified or dispersed product; and
heating the emulsified or dispersed product,
wherein the toner material comprises a binder resin, the colorant, and the releasing agent.

3. The toner according to claim 2, wherein the aqueous medium comprises a surfactant and
the process further comprises:
removing the surfactant after the emulsifying or dispersing, thereby obtaining a slurry; and
heating the slurry at a temperature satisfying an expression:
a glass transition temperature (Tg) of the binder resin≤heating temperature≤Tg of the binder resin+15° C.

4. The toner according to claim 3, wherein the slurry is heated at from 50° C. to 60° C. for 30 minutes or less.

5. The toner according to claim 2,
wherein the toner material comprises:
an active hydrogen group-comprising compound;
a polymer reactive with the active hydrogen group-comprising compound;
the colorant;
the releasing agent; and
an unmodified polyester resin as the binder resin,
wherein the aqueous media comprises a surfactant, and
wherein the dissolving or dispersing is dissolving or dispersing the toner material in the organic solvent, thereby obtaining a dissolved or dispersed product, and the emulsifying or dispersing is dispersing the dissolved or dispersed product in the aqueous medium, thereby reacting the active hydrogen group-comprising compound with the polymer.

6. The toner according to claim 2, wherein the organic solvent is at least one selected from the group consisting of toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone.

7. The toner according to claim 6,
wherein the organic solvent is at least one selected from the group consisting of toluene, xylene, benzene, methylene chloride, 1,2-dichloroethane, chloroform, carbon tetrachloride, and ethyl acetate.

8. The toner according to claim 7, wherein the organic solvent is ethyl acetate.

9. The toner according to claim 1, wherein the releasing agent comprises at least microcrystalline wax.

10. The toner according to claim 9, wherein a melting point of the at least microcrystalline wax is from 50° C. to 90° C.

11. The toner according to claim 1, wherein the proportion of the toner particles comprising a void having a diameter D1 of larger than 0.0 μm and no more than 0.5 μm is from 7.0% to 50%, and a proportion of the toner particles comprising a void having a diameter D2 of 1.0 μm or larger is 5% or less.

12. The toner according to claim 11, wherein the proportion of the toner particles comprising a void having a diameter D1 of larger than 0.0 μm and no more than to 0.5 μm is from 10.0% to 40%, and a proportion of the toner particles comprising a void having a diameter D2 of 1.0 μm or larger is 3% or less.

13. A developer, comprising:
a toner comprising toner particles comprising: a binder resin, a colorant, and a releasing agent; and
a carrier, wherein a proportion of the toner particles comprising a void having a diameter D1 of larger than 0.0 μm and no more than 0.5 μm is more than 5.0% and no more than 60%, a proportion of the toner particles comprising a void having a diameter D2 of 1.0 μm or larger is 10% or less, and a cross-sectional shape of the void is substantially circular or elliptical.

14. The developer according to claim 13, wherein the proportion of the toner particles comprising a void having a diameter D1 of larger than 0.0 μm and no more than 0.5 μm is from 7.0% to 50%, and a proportion of the toner particles comprising a void having a diameter D2 of 1.0 μm or larger is 5% or less.

15. The developer according to claim 14, wherein the proportion of the toner particles comprising a void having a diameter D1 of larger than 0.0 μm and no more than 0.5 μm is from 10.0% to 40%, and a proportion of the toner particles comprising a void having a diameter D2 of 1.0 μm or larger is 3% or less.

* * * * *